US010818261B2

(12) United States Patent
Luo et al.

(10) Patent No.: US 10,818,261 B2
(45) Date of Patent: Oct. 27, 2020

(54) GATE DRIVING UNIT CIRCUIT PAIR AND DRIVING METHOD THEREOF, GATE DRIVING CIRCUIT AND DISPLAY DEVICE

(71) Applicants: HEFEI BOE DISPLAY TECHNOLOGY CO., LTD., Hefei, Anhui (CN); BOE TECHNOLOGY GROUP CO., LTD., Beijing (CN)

(72) Inventors: Bin Luo, Beijing (CN); Hao Chen, Beijing (CN); Jincheng Jia, Beijing (CN); Yunfei Liu, Beijing (CN); Wei Zhang, Beijing (CN)

(73) Assignees: HEFEI BOE DISPLAY TECHNOLOGY CO., LTD., Hefei, Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/460,245

(22) Filed: Jul. 2, 2019

(65) Prior Publication Data

US 2020/0035184 A1 Jan. 30, 2020

(30) Foreign Application Priority Data

Jul. 27, 2018 (CN) ..... 2018 1 0842669

(51) Int. Cl.
*G09G 3/36* (2006.01)

(52) U.S. Cl.
CPC ..... *G09G 3/3677* (2013.01); *G09G 2310/08* (2013.01); *G09G 2330/08* (2013.01)

(58) Field of Classification Search
None
See application file for complete search history.

(56) References Cited

U.S. PATENT DOCUMENTS

| | | | | |
|---|---|---|---|---|
| 6,433,623 | B1 * | 8/2002 | Okutsu | H02M 3/07 307/110 |
| 2003/0156439 | A1 * | 8/2003 | Ohmichi | H02M 7/538 363/98 |
| 2017/0153742 | A1 * | 6/2017 | Pang | G06F 3/0416 |
| 2018/0197496 | A1 * | 7/2018 | Gao | G09G 3/3677 |
| 2019/0103166 | A1 * | 4/2019 | Yuan | G09G 3/3266 |
| 2020/0020410 | A1 * | 1/2020 | Du | G11C 19/287 |

* cited by examiner

*Primary Examiner* — Parul H Gupta
(74) *Attorney, Agent, or Firm* — Nath, Goldberg & Meyer; Joshua B. Goldberg

(57) ABSTRACT

A gate driving unit circuit pair and a driving method thereof, a gate driving circuit and a display device are provided. The gate driving unit circuit pair includes two gate driving unit circuits, each of which includes a first output sub-circuit, a second output sub-circuit, and a coupling and isolation sub-circuit. The coupling and isolation sub-circuit is configured to: if the first output sub-circuit outputs signal, isolate the signal of the first output terminal from the signal of the second output terminal; or else, couple the signal of the first output terminal to the second output terminal.

20 Claims, 4 Drawing Sheets

GATE DRIVING UNIT CIRCUIT PAIR AND DRIVING METHOD THEREOF, GATE DRIVING CIRCUIT AND DISPLAY DEVICE

CROSS-REFERENCE TO RELATED APPLICATIONS

The present application claims the priority of Chinese Patent Application No. 201810842669.3, entitled "Gate Driving Unit Group and Driving Method thereof, Gate Driving Circuit and Display Device", filed on Jul. 27, 2018, in the Chinese Intellectual Property Office, the disclosure of which is incorporated herein in its entirety by reference.

TECHNICAL FIELD

The present disclosure relates to the field of display technology, and in particular, to a gate driving unit circuit pair and a driving method thereof, a gate driving circuit, and a display device.

BACKGROUND

A Gate on Array (GOA) circuit is a circuit composed of several thin film transistors (TFTs) and capacitors, which is applied in the field of liquid crystal display, such that a liquid crystal panel displays in a progressive scanning manner. Compared with a conventional manner adopting a gate driver IC, the GOA circuit and a pixel electrode can be prepared simultaneously utilizing an existing array process, which not only can reduce manufacturing cost of the liquid crystal panel but also can meet requirements for narrow bezel and the like.

SUMMARY

According to an embodiment of the present disclosure, there is provided a gate driving unit circuit pair comprising a first gate driving unit circuit and a second gate driving unit circuit, wherein the first gate driving unit circuit and the second gate driving unit circuit are configured to drive a same pixel circuit simultaneously; each of the first gate driving unit circuit and the second gate driving unit circuit comprises an input sub-circuit, a reset sub-circuit, a first output sub-circuit, a second output sub-circuit, a coupling and isolation sub-circuit, an input terminal, a reset terminal, a first preset power supply terminal, a clock signal terminal, a first output terminal, and a second output terminal; the input sub-circuit, the reset sub-circuit, the first output sub-circuit, and the second output sub-circuit are coupled to a pull-up node; the first output terminal is coupled respectively to the second output sub-circuit and the coupling and isolation sub-circuit; the second output terminal is coupled respectively to the first output sub-circuit and the coupling and isolation sub-circuit; and the first output terminal of the first gate driving unit circuit is coupled to the first output terminal of the second gate driving unit circuit. The input sub-circuit is configured to input an input signal provided by the input terminal to the pull-up node; the first output sub-circuit is configured to output and provide a clock signal provided by the clock signal terminal to the second output terminal under a control of a voltage of the pull-up node; the second output sub-circuit is configured to output and provide the clock signal provided by the clock signal terminal to the first output terminal under the control of the voltage of the pull-up node; the reset sub-circuit is configured to reset the pull-up node via a voltage provided by the first preset power supply terminal under a control of a reset signal provided by the reset terminal; and the coupling and isolation sub-circuit is configured to isolate a signal of the first output terminal from a signal of the second output terminal in response to the first output sub-circuit outputting the clock signal to the second output terminal, and couple the signal of the first output terminal to the second output terminal in response to the first output sub-circuit not outputting the clock signal.

According to an embodiment of the present disclosure, the coupling and isolation sub-circuit comprises a first capacitor, wherein a first terminal of the first capacitor is coupled to the second output terminal, and a second terminal of the first capacitor is coupled to the first output terminal.

According to an embodiment of the present disclosure, the first output sub-circuit comprises a first transistor, wherein a control terminal of the first transistor is coupled to the pull-up node, a first terminal of the first transistor is coupled to the clock signal terminal, and a second terminal of the first transistor is coupled to the second output terminal.

According to an embodiment of the present disclosure, the second output sub-circuit comprises: a second transistor, wherein a control terminal of the second transistor is coupled to the pull-up node, and a first terminal of the second transistor is coupled to the clock signal terminal; and a second capacitor, wherein a first terminal of the second capacitor is coupled to the pull-up node, and a second terminal of the second capacitor is coupled to a second terminal of the second transistor and the first output terminal.

According to an embodiment of the present disclosure, the input sub-circuit comprises a third transistor, wherein a first terminal and a control terminal of the third transistor are coupled to the input terminal, respectively, and a second terminal of the third transistor is coupled to the pull-up node; the reset sub-circuit comprises a fourth transistor, wherein a control terminal of the fourth transistor is coupled to the reset terminal, a first terminal of the fourth transistor is coupled to the pull-up node, and a second terminal of the fourth transistor is coupled to the first preset power supply terminal.

According to an embodiment of the present disclosure, a capacitance value of the first capacitor satisfies the following condition:

$$\frac{C_1}{C_1+C_2}\times\Delta V_G - V_{LVGL} \geq \max(V_{th}(M3),\ V_{th}(M4)),$$

wherein, $C_1$ is the capacitance value of the first capacitor, $C_2$ is a capacitance value of the second capacitor, $\Delta V_G$ is pulse voltage amplitude output by the first gate driving unit circuit and the second gate driving unit circuit in the gate driving unit circuit pair, $V_{LVGL}$ is a voltage provided by the first preset power supply terminal, $V_{th}$(M3) is a turn-on voltage of the third transistor, and $V_{th}$(M4) is a turn-on voltage of the fourth transistor.

According to an embodiment of the present disclosure, each of the first gate driving unit circuit and the second gate driving unit circuit further comprises a noise control sub-circuit, a first de-noising sub-circuit, a first noise reduction control terminal, and a second noise reduction control terminal, wherein the noise control sub-circuit and the first de-noising sub-circuit are respectively coupled to both a first pull-down node and a second pull-down node, and the first pull-down node is different from the second pull-down node;

the noise control sub-circuit is further coupled to the first noise reduction control terminal, the second noise reduction control terminal, and the first preset power supply terminal, respectively, and is configured to pull up a voltage of the first pull-down node based on a first noise reduction signal provided by the first noise reduction control terminal and to pull up a voltage of the second pull-down node based on a second noise reduction signal provided by the second noise reduction control terminal; the first de-noising sub-circuit is further coupled to the pull-up node and the first preset power supply terminal, respectively, and is configured to de-noise the voltage of the pull-up node via the voltage provided by the first preset power supply terminal under a control of the voltage of at least one of the first pull-down node and the second pull-down node.

According to an embodiment of the present disclosure, each of the first gate driving unit circuit and the second gate driving unit circuit further comprises a second de-noising sub-circuit and a second preset power supply terminal, wherein the second de-noising sub-circuit is coupled to the first output terminal, the first pull-down node, the second pull-down node, and the second preset power supply terminal, respectively, and is configured to de-noise an output signal of the first output terminal via a voltage provided by the second preset power supply terminal under the control of the voltage of at least one of the first pull-down node and the second pull-down node.

According to an embodiment of the present disclosure, each of the first gate driving unit circuit and the second gate driving unit circuit further comprises a third de-noising sub-circuit, wherein the third de-noising sub-circuit is coupled to the second output terminal, the first pull-down node, the second pull-down node, and the first preset power supply terminal, respectively, and is configured to de-noise an output signal of the second output terminal via the voltage provided by the first preset power supply terminal under the control of the voltage of at least one of the first pull-down node and the second pull-down node.

According to an embodiment of the present disclosure, the noise control sub-circuit comprises a first noise control sub-circuit and a second noise control sub-circuit, wherein the first noise control sub-circuit comprises: a fifth transistor, wherein a first terminal and a control terminal of the fifth transistor are coupled to the first noise reduction control terminal, respectively; a sixth transistor, wherein a control terminal of the sixth transistor is coupled to a second terminal of the fifth transistor, a first terminal of the sixth transistor is coupled to the first noise reduction control terminal, and a second terminal of the sixth transistor is coupled to the first pull-down node; a seventh transistor, wherein a first terminal of the seventh transistor is coupled to the second terminal of the fifth transistor, and a second terminal of the seventh transistor is coupled to the first preset power supply terminal; an eighth transistor, wherein a first terminal of the eighth transistor is coupled to the first pull-down node, a second terminal of the eighth transistor is coupled to the first preset power supply terminal, and a control terminal of the eighth transistor is coupled to a control terminal of the seventh transistor and the pull-up node. The second noise control sub-circuit comprises: a ninth transistor, wherein a first terminal and a control terminal of the ninth transistor are coupled to the second noise reduction control terminal, respectively; a tenth transistor, wherein a control terminal of the tenth transistor is coupled to a second terminal of the ninth transistor, a first terminal of the tenth transistor is coupled to the second noise reduction control terminal, and a second terminal of the tenth transistor is coupled to the second pull-down node; an eleventh transistor, wherein a first terminal of the eleventh transistor is coupled to the second terminal of the ninth transistor, and a second terminal of the eleventh transistor is coupled to the first preset power supply terminal; a twelfth transistor, wherein a first terminal of the twelfth transistor is coupled to the second pull-down node, a second terminal of the twelfth transistor is coupled to the first preset power supply terminal, and a control terminal of the twelfth transistor is coupled to a control terminal of the eleventh transistor and the pull-up node.

According to an embodiment of the present disclosure, the first de-noising sub-circuit comprises: a thirteenth transistor, wherein a control terminal of the thirteenth transistor is coupled to the first pull-down node, a first terminal of the thirteenth transistor is coupled to the pull-up node, and a second terminal of the thirteenth transistor is coupled to the first preset power supply terminal; a fourteenth transistor, wherein a control terminal of the fourteenth transistor is coupled to the second pull-down node, a first terminal of the fourteenth transistor is coupled to the pull-up node, and a second terminal of the fourteenth transistor is coupled to the first preset power supply terminal.

According to an embodiment of the present disclosure, the second de-noising sub-circuit comprises: a fifteenth transistor, wherein a control terminal of the fifteenth transistor is coupled to the first pull-down node, a first terminal of the fifteenth transistor is coupled to the first output terminal, and a second terminal of the fifteenth transistor is coupled to the second preset power supply terminal; a sixteenth transistor, wherein a control terminal of the sixteenth transistor is coupled to the second pull-down node, a first terminal of the sixteenth transistor is coupled to the first output terminal, and a second terminal of the sixteenth transistor is coupled to the second preset power supply terminal.

According to an embodiment of the present disclosure, the third de-noising sub-circuit comprises: a seventeenth transistor, wherein a control terminal of the seventeenth transistor is coupled to the first pull-down node, a first terminal of the seventeenth transistor is coupled to the second output terminal, and a second terminal of the seventeenth transistor is coupled to the first preset power supply terminal; an eighteenth transistor, wherein a control terminal of the eighteenth transistor is coupled to the second pull-down node, a first terminal of the eighteenth transistor is coupled to the second output terminal, and a second terminal of the eighteenth transistor is coupled to the first preset power supply terminal.

According to an embodiment of the present disclosure, each of the first gate driving unit circuit and the second gate driving unit circuit further comprises a discharge sub-circuit and a frame start terminal, wherein the discharge sub-circuit is coupled to the frame start terminal, the pull-up node, and the first preset power supply terminal, respectively, and is configured to pull down the voltage of the pull-up node via the voltage provided by the first preset power supply terminal under a control of a frame start signal provided by the frame start terminal.

According to an embodiment of the present disclosure, wherein the discharge sub-circuit comprises: a nineteenth transistor, wherein a control terminal of the nineteenth transistor is coupled to the frame start terminal, a first terminal of the nineteenth transistor is coupled to the pull-up node, and a second terminal of the nineteenth transistor is coupled to the first preset power supply terminal.

According to an embodiment of the present disclosure, there is provided a driving method for a gate driving unit circuit pair comprising a first gate driving unit circuit and a second gate driving unit circuit, wherein the first gate driving unit circuit and the second gate driving unit circuit are configured to drive a same pixel circuit simultaneously; each of the first gate driving unit circuit and the second gate driving unit circuit comprises an input sub-circuit, a reset sub-circuit, a first output sub-circuit, a second output sub-circuit, a coupling and isolation sub-circuit, an input terminal, a reset terminal, a first preset power supply terminal, a clock signal terminal, a first output terminal, and a second output terminal; the input sub-circuit, the reset sub-circuit, the first output sub-circuit, and the second output sub-circuit are coupled to a pull-up node; the first output terminal is coupled respectively to the second output sub-circuit and the coupling and isolation sub-circuit; the second output terminal is coupled respectively to the first output sub-circuit and the coupling and isolation sub-circuit; and the first output terminal of the first gate driving unit circuit is coupled to the first output terminal of the second gate driving unit circuit. For each of the first gate driving unit circuit and the second gate driving unit circuit, the driving method comprises: inputting an input signal provided by the input terminal, via the input sub-circuit, to the pull-up node; outputting and providing a clock signal provided by the clock signal terminal, via the first output sub-circuit, to the second output terminal under a control of a voltage of the pull-up node; outputting and providing the clock signal provided by the clock signal terminal, via the second output sub-circuit, to the first output terminal under the control of the voltage of the pull-up node; resetting the pull-up node, via the reset sub-circuit, by a voltage provided by the first preset power supply terminal under a control of a reset signal provided by the reset terminal; isolating a signal of the first output terminal from a signal of the second output terminal via the coupling and isolation sub-circuit in response to the first output sub-circuit outputting the clock signal to the second output terminal, and coupling the signal of the first output terminal to the second output terminal via the coupling and isolation sub-circuit in response to the first output sub-circuit not outputting the clock signal.

According to an embodiment of the present disclosure, when the first output sub-circuit of the first gate driving unit circuit does not output the clock signal, the signal of the first output terminal of the first gate driving unit circuit is a clock signal output by one of the second output sub-circuit of the first gate driving unit circuit and the second output sub-circuit of the second gate driving unit circuit.

According to an embodiment of the present disclosure, there is provided a gate driving circuit comprising the gate driving unit circuit pair above, a start signal line, a clock signal line, a first noise reduction control line, a second noise reduction control line, a frame start signal line, a first preset power supply line, and a second preset power supply line. The input terminal of the first gate driving unit circuit in a 1st gate driving unit circuit pair is coupled to the start signal line, the second output terminal of the first gate driving unit circuit in the 1st gate driving unit circuit pair is coupled to the input terminal of the first gate driving unit circuit in a 2nd gate driving unit circuit pair, and the second output terminal of the first gate driving unit circuit in an i-th gate driving unit circuit pair is coupled to the reset terminal of the first gate driving unit circuit in an (i−1)-th gate driving unit circuit pair and the input terminal of the first gate driving unit circuit in an (i+1)-th gate driving unit circuit pair, respectively, wherein i is a positive integer greater than 1; the input terminal of the second gate driving unit circuit in the 1st gate driving unit circuit pair is coupled to the start signal line, the second output terminal of the second driving unit circuit in the 1st gate driving unit circuit pair is coupled to the input terminal of the second gate driving unit circuit in the 2nd gate driving unit circuit pair, and the second output terminal of the second gate driving unit circuit in the i-th gate driving unit circuit pair is coupled to the reset terminal of the second gate driving unit circuit in the (i−1)-th gate driving unit circuit pair and the input terminal of the second gate driving unit circuit in the (i+1)-th gate driving unit circuit pair; the first output terminals of the first gate driving unit circuit and the second gate driving unit circuit in each of the gate driving unit circuit pairs are coupled to a gate line of a same pixel circuit; the clock signal terminal, a first noise reduction control terminal, a second noise reduction control terminal, a frame start terminal, the first preset power supply terminal, and a second preset power supply terminal of the first gate driving unit circuit in each of the gate driving unit circuit pairs are coupled to the clock signal line, the first noise reduction control line, the second noise reduction control line, the frame start signal line, the first preset power supply line, and the second preset power supply line, respectively; and the clock signal terminal, a first noise reduction control terminal, a second noise reduction control terminal, a frame start terminal, the first preset power supply terminal, and the second preset power supply terminal of the second gate driving unit circuit in each of the gate driving unit circuit pairs are coupled to the clock signal line, the first noise reduction control line, the second noise reduction control line, the frame start signal line, the first preset power supply line, and the second preset power supply line, respectively.

According to an embodiment of the present disclosure, there is provided a display device comprising the gate driving circuit above.

According to an embodiment of the present disclosure, there is provided a gate driving unit circuit pair comprising a first gate driving unit circuit and a second gate driving unit circuit, wherein the first gate driving unit circuit and the second gate driving unit circuit are configured to drive a same pixel circuit simultaneously, and each of the first gate driving unit circuit and the second gate driving unit circuit comprises: a first transistor, a second transistor, a third transistor, a fourth transistor, a fifth transistor, a sixth transistors, a seventh transistor, an eighth transistor, a ninth transistor, a tenth transistor, an eleventh transistor, a twelfth transistor, a thirteenth transistor, a fourteenth transistor, a fifteenth transistor, a sixteenth transistor, a seventeenth transistor, an eighteenth transistor, a nineteenth transistor, a first capacitor, a second capacitor, an input terminal, a reset terminal, a first output terminal, a second output terminal, a first noise reduction control terminal, a second noise reduction control terminal, a first preset power supply terminal, a second preset power supply terminal, a frame start terminal, and a clock signal terminal. A control terminal of the first transistor is respectively coupled to a control terminal of the second transistor, a second terminal of the third transistor, a first terminal of the fourth transistor, a control terminal of the seventh transistor, a control terminal of the eighth transistor, a control terminal of the eleventh transistor, a control terminal of the twelfth transistor, a first terminal of the thirteenth transistor, a first terminal of the fourteenth transistor, a first terminal of the nineteenth transistor and a first terminal of the second capacitor; a first terminal of the first transistor is coupled to the clock signal terminal; and a second terminal of the first transistor is respectively coupled to the second output terminal, a first terminal of the first capacitor, a first terminal of the seventeenth transistor and a first terminal of the eighteenth transistor. A first terminal of the second transistor is coupled to the clock signal terminal; a second terminal of the second transistor is respectively coupled to the first output terminal, a second terminal of the second capacitor, a second terminal of the first capacitor, a first terminal of the fifteenth transistor, and a first terminal of the sixteenth transistor; a first terminal and a control terminal of the third transistor are respectively coupled to the input terminal; a control terminal of the fourth transistor is coupled to the reset terminal, and a second terminal of the fourth transistor is coupled to the first preset power supply terminal; a first terminal and a control terminal of the fifth transistor are respectively coupled to the first noise reduction control terminal, and a second terminal of the fifth transistor is respectively coupled to a control terminal of the sixth transistor and a first terminal of the seventh transistor; a first terminal of the sixth transistor is coupled to the first noise reduction control terminal, and a second terminal of the sixth transistor is respectively coupled to a first terminal of the eighth transistor, a control terminal of the thirteenth transistor, a control terminal of the fifteenth transistor and a control terminal of the seventeenth transistor; a second terminal of the seventh transistor is coupled to the first preset power supply terminal; a second terminal of the eighth transistor is coupled to the first preset power supply terminal; a first terminal and a control terminal of the ninth transistor are respectively coupled to the second noise reduction control terminal, and a second terminal of the ninth transistor is respectively coupled to a control terminal of the tenth transistor and a first terminal of the eleventh transistor; a first terminal of the tenth transistor is coupled to the second noise reduction control terminal, and the second terminal of the tenth transistor is respectively coupled to a first terminal of the twelfth transistor, a control terminal of the fourteenth transistor, a control terminal of the sixteenth transistor, and a control terminal of the eighteenth transistor; a second terminal of the eleventh transistor is coupled to the first preset power supply terminal; a second terminal of the twelfth transistor is coupled to the first preset power supply terminal; a second terminal of the thirteenth transistor is coupled to the first preset power supply terminal; a second terminal of the fourteenth transistor is coupled to the first preset power supply terminal; a second terminal of the fifteenth transistor is coupled to the second preset power supply terminal; a second terminal of the sixteenth transistor is coupled to the second preset power supply terminal; a second terminal of the seventeenth transistor is coupled to the first preset power supply terminal; a second terminal of the eighteenth transistor is coupled to the first preset power supply terminal; a control terminal of the nineteenth transistor is coupled to the frame start terminal, and a second terminal of the nineteenth transistor is coupled to the first preset power supply terminal. The first output terminal of the first gate driving unit circuit is coupled to the first output terminal of the second gate driving unit circuit to drive the same pixel circuit simultaneously.

DETAILED DESCRIPTION

Figure 1:
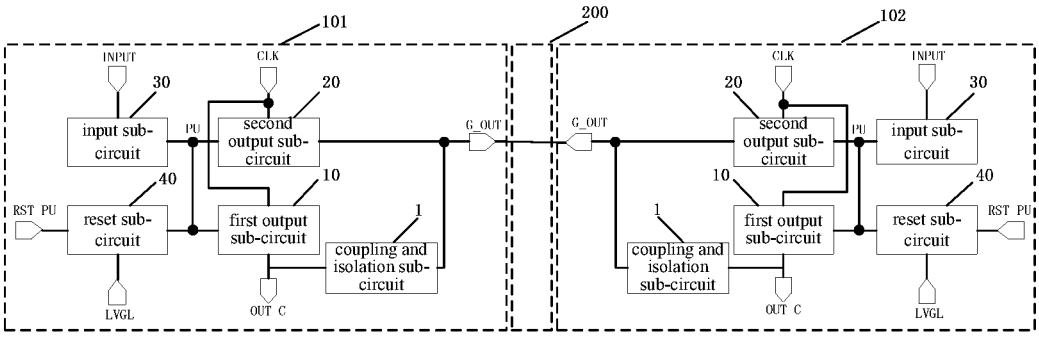
FIG. 1 is a schematic diagram of a structure of a gate driving unit circuit pair according to one embodiment of the present disclosure.

Embodiments of the present disclosure are described in detail below, and examples of the embodiments are illustrated in the accompanying drawings, wherein the same or similar reference numerals always refer to the same or similar elements or elements having the same or similar functions. The embodiments described below with reference to the drawings are exemplary and intended to be used for the purpose of interpreting the present disclosure, and not to be construed as a limitation of the present disclosure.

The present disclosure is based on knowledge and research on the following issues. A large size liquid crystal display panel (such as 55 inches and above) may adopt a GOA circuit with a structure of 17T1C (17 transistors, 1 capacitor) or 19T1C (19 transistors, 1 capacitor), and may be driven at two sides simultaneously. For a GOA circuit with the structure of 17T1C, when there is a short-circuit fault (such as, a short circuit between a gate of a pixel circuit and a pixel electrode) in the panel, a wrong signal will enter upper and lower levels of the GOA circuit through a gate line, which not only may result in abnormal display of the current row, but also may result in abnormal display of several upper and lower rows, or even may directly result in black screen. For a GOA circuit with the structure of 19T1C, when abnormality occurs in a GOA circuit located at one side and causes absence of output signal, an output signal of a GOA circuit at the opposite side cannot be fed in, causing inter-cascaded GOA circuits at the said one side to have no output due to absence of input signal, thereby causing overload of a clock signal terminal of the GOA circuit at the opposite side. Also, because the gate is insufficiently turned on, a pixel capacitor is undercharged, causing abnormal display of the screen.

A gate driving unit circuit pair and a driving method thereof, a gate driving circuit, and a display device according to embodiments of the present disclosure will be described below with reference to the accompanying drawings.

FIG. 1 is a schematic diagram of a structure of a gate driving unit circuit pair according to one embodiment of the present disclosure.

As shown in FIG. 1, the gate driving unit circuit pair includes a first gate driving unit circuit 101 and a second gate driving unit circuit 102. The first gate driving unit circuit 101 and the second gate driving unit circuit 102 are configured to simultaneously drive the same pixel circuit 200. Each of the first gate driving unit circuit 101 and the second gate driving unit circuit 102 includes an input sub-circuit 30, a reset sub-circuit 40, a first output sub-circuit 10, a second output sub-circuit 20, a coupling and isolation sub-circuit 1, an input terminal INPUT, a reset terminal RST_PU, a first preset power supply terminal LVGL, a clock signal terminal CLK, a first output terminal G_OUT and a second output terminal OUT_C. The input sub-circuit 30, the reset sub-circuit 40, the first output sub-circuit 10, and the second output sub-circuit 20 are coupled to a pull-up node PU. The first output terminal G_OUT is coupled to the second output sub-circuit 20 and the coupling and isolation sub-circuit 1 respectively, and the second output terminal OUT_C is coupled to the first output sub-circuit 10 and the coupling and isolation sub-circuit 1 respectively. The first output terminal G_OUT of the first gate driving unit circuit 101 is coupled to the first output terminal G_OUT of the second gate driving unit circuit 102 through a gate line of the pixel circuit 200.

The input sub-circuit 30 is configured to input an input signal provided by the input terminal INPUT to the pull-up node PU. The first output sub-circuit 10 is configured to output and provide a clock signal provided by the clock signal terminal CLK to the second output terminal OUT_C under a control of a voltage of the pull-up node PU. The second output sub-circuit 20 is configured to output and provide the clock signal provided by the clock signal terminal CLK to the first output terminal G_OUT under the control of the voltage of the pull-up node PU. The reset sub-circuit 40 is configured to reset the pull-up node PU by a voltage provided by the first preset power supply terminal LVGL under a control of a reset signal provided by the reset terminal RST_PU. The coupling and isolation sub-circuit 1 is configured to isolate a signal of the first output terminal G_OUT from a clock signal of the second output terminal OUT_C when the first output sub-circuit 10 outputs the clock signal to the second output terminal OUT_C, and to couple the signal of the first output terminal G_OUT to the second output terminal OUT_C when the first output sub-circuit 10 does not output the clock signal.

When the gate driving unit circuit pair shown in FIG. 1 is operating, if both the first gate driving unit circuit 101 and the second gate driving unit circuit 102 in the gate driving unit circuit pair can normally operate and there is a short circuit in the pixel circuit 200, then the second output terminal OUT_C of the first gate driving unit circuit 101 and the second output terminal OUT_C of the second gate driving unit circuit 102 are both capable of outputting a clock signal, but voltages of the first output terminal G_OUT of the first gate driving unit circuit 101 and the first output terminal G_OUT of the second gate driving unit circuit 102 are pulled down by the short-circuited pixel circuit 200. At this time, due to an isolation effect of the coupling and isolation sub-circuit 1, a voltage of the second output terminal OUT_C of the first gate driving unit circuit 101 and a voltage of the second output terminal OUT_C of the second gate driving unit circuit 102 are not influenced by the voltages of corresponding first output terminals G_OUT, so that the second output terminal OUT_C of the first gate driving unit circuit 101 and the second output terminal OUT_C of the second gate driving unit circuit 102 can output clock signals to corresponding upper and lower level gate driving unit circuits, enabling the upper and lower level gate driving unit circuits to have normal output.

The first output terminals G_OUT of the first and second gate driving unit circuits 101 and 102 are coupled to each other through the gate line of the pixel circuit 200, and can simultaneously drive the same pixel circuit 200. The second output terminals OUT_C of the first and second gate driving unit circuits 101 and 102 may be configured to be respectively coupled to the reset terminals RST_PU of corresponding previous level gate driving unit circuits, to reset the corresponding previous level gate driving unit circuits. The second output terminals OUT_C of the first and second gate driving unit circuits 101 and 102 may be configured to be respectively coupled to the input terminals of corresponding next level gate driving unit circuits, to provide input signals to the corresponding next level gate driving unit circuits.

When the gate driving unit circuit pair shown in FIG. 1 is operating, if one of the first and second gate driving unit circuits 101 and 102 in the gate driving unit circuit pair encounters a fault making its second terminal OUT_C unable to output a clock signal a voltage at the first output terminal G_OUT of the faulted gate driving unit circuit, via a coupling effect of the coupling and isolation sub-circuit 1, can be coupled to the second output terminal OUT_C thereof, and can be output to corresponding upper and lower level gate driving unit circuits via the second output terminal OUT_C, so that the upper and lower level gate driving unit circuits can have normal output. The voltage at the first output terminal G_OUT of the faulted gate driving unit circuit may be a clock signal output by the second output sub-circuit of the faulted gate driving unit circuit (when the second output sub-circuit 20 of the faulted gate driving unit circuit operates normally), or may also be a clock signal output by the second output sub-circuit of the un-faulted gate driving unit circuit via the first output terminal G_OUT thereof (when the second output sub-circuit 20 of the faulted gate driving unit circuit cannot operate normally).

Figure 2:
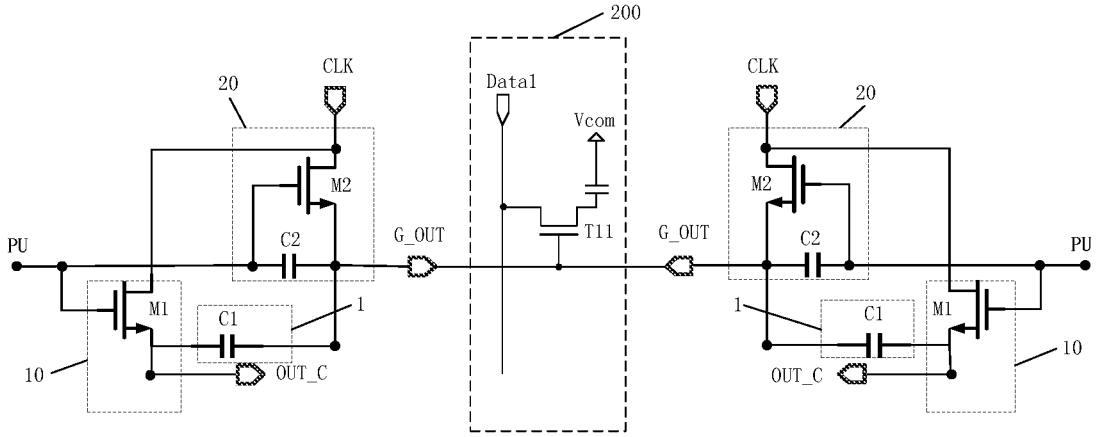
FIG. 2 is a schematic diagram of a partial structure of a gate driving unit circuit pair according to one embodiment of the present disclosure.

According to one embodiment of the present disclosure, as shown in FIG. 2, the coupling and isolation sub-circuit 1 includes a first capacitor C1. A first terminal of the first capacitor C1 is coupled to the second output terminal OUT_C, and a second terminal of the first capacitor C1 is coupled to the first output terminal G_OUT. Taking the first gate driving unit circuit 101 as an example, when the first gate driving unit circuit 101 operates normally and the pixel circuit 200 is short-circuited, the first capacitor C1 plays a function of isolation, so that the second output terminal OUT_C outputs a clock signal, without being affected by voltage decline of the first output terminal G_OUT caused by the short circuit of the pixel circuit 200. When the second output terminal OUT_C of the first gate driving unit circuit 101 cannot output a clock signal, the first capacitor C1 plays a function of bootstrap and coupling, and couples the voltage of the first output terminal G_OUT to the second output terminal OUT_C. Of course, the coupling and isolation sub-circuit 1 may also adopt other components, such as a diode, whose anode is coupled to the first output terminal G_OUT, and whose cathode is coupled to the second output terminal OUT_C. The coupling and isolation functions are based on unidirectional conduction of the diode, but the present disclosure is not limited to this.

According to one embodiment of the present disclosure, the first output sub-circuit 10 includes a first transistor M1. A control terminal of the first transistor M1 is coupled to the pull-up node PU, a first terminal of the first transistor M1 is coupled to the clock signal terminal CLK, and a second terminal of the first transistor M1 is coupled to the second output terminal OUT_C. Under the potential control of the pull-up node PU, the first transistor M1 is turned on, and can provide the clock signal from the clock signal terminal CLK to the second output terminal OUT_C.

According to one embodiment of the present disclosure, as shown in FIG. 2, the second output sub-circuit 20 includes a second transistor M2 and a second capacitor C2. A control terminal of the second transistor M2 is coupled to the pull-up node PU, a first terminal of the second transistor M2 is coupled to the clock signal terminal CLK, and a second terminal of the second transistor M2 is coupled to the first output terminal G_OUT. A first terminal of the second capacitor C2 is coupled to the pull-up node PU, and a second terminal of the second capacitor C2 is respectively coupled to the second terminal of the second transistor M2 and the first output terminal G_OUT.

That is, in the embodiment of the present disclosure, a dual-side simultaneous driving method is adopted in which, one pixel circuit is driven by two gate driving unit circuits, that is, the present disclosure is mainly applied to a dual-side driven liquid crystal panel. Each of the gate driving unit circuits includes two output terminals: the first output terminal G_OUT and the second output terminal OUT_C. The first output terminal G_OUT is coupled to the gate line of the pixel circuit 200, and is used for providing a gate signal to a gate load of the pixel circuit 200, to turn on a transistor (such as T11) of the pixel circuit 200. The second output terminal OUT_C is coupled to the reset terminal RST_PU of the previous level gate driving unit circuit of this gate driving unit circuit, to provide a reset signal to the previous level gate driving unit circuit. At the same time, the second output terminal OUT_C is coupled to the input terminal INPUT of the next level gate driving unit circuit of this gate driving unit circuit, to provide an input signal to the next level gate driving unit circuit.

For example, as shown in FIG. 2, when the voltage of the pull-up node PU is at a high level, both the first transistor M1 and the second transistor M2 are turned on. The clock signal provided by the clock signal terminal CLK, on one hand, passes through the second transistor M2 and after that, provides a gate signal to the gate load of the pixel circuit 200 via the first output terminal G_OUT; and on the other hand, passes through the first transistor M1 and after that, provides a reset signal to the previous level gate driving unit circuit and an input signal to the next level gate driving unit circuit, via the second output terminal OUT_C.

When both the first gate driving unit circuit 101 and the second gate driving unit circuit 102 operate normally and the pixel circuit 200 is not short-circuited, under the control of voltage of the pull-up node PU, the two gate driving unit circuits respectively provide gate signals to the pixel circuit 200 via respective first output terminals G_OUT thereof, and provide reset signals to the corresponding previous level gate driving unit circuits and input signals to the corresponding next level gate driving unit circuits via respective second output terminals OUT_C.

When the pixel circuit 200 is short-circuited so that the gate signal of the pixel circuit 200 is pulled down, the output signal of the second output terminal OUT_C is not affected due to the isolation effect of the first capacitor C1. When one of the two gate driving unit circuits abnormally operates so that no signal is output from the first output terminal G_OUT and the second output terminal OUT_C of the faulted gate driving unit circuit, the gate signal is provided to the pixel circuit 200 by the first output terminal G_OUT of the un-faulted gate driving unit circuit. And due to the bootstrap and coupling effect of the first capacitor C1 of the faulted gate driving unit circuit, the output signal at the second output terminal OUT_C of the faulted gate driving unit circuit is pulled up, to provide the reset signal to the corresponding previous-level gate driving unit circuit and the input signal to the corresponding next-level gate driving unit circuit. When one of the two gate driving unit circuits abnormally operates so that the second output sub-circuit 20 of the gate driving unit circuit outputs a signal and the first output sub-circuit thereof outputs no signal, the output signal at its own second output terminal OUT_C can be pulled up by the signal output from its own second output sub-circuit.

Figure 3:
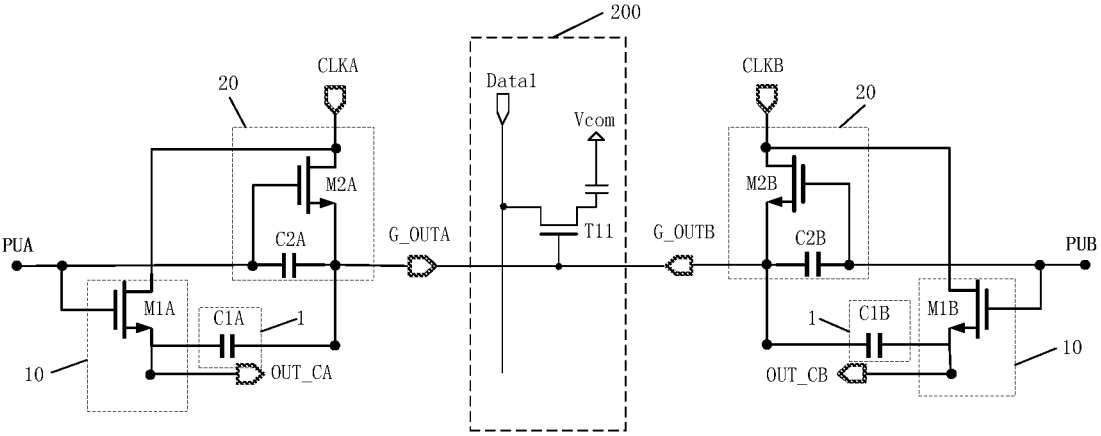
FIG. 3 is a schematic diagram of a gate driving unit circuit pair driving a pixel circuit according to one embodiment of the present disclosure.

For example, for convenience of explanation, the reference numerals of the components of the first gate driving unit circuit 101 and the second gate driving unit circuit 102 shown in FIG. 3 are distinguished.

Specifically, as shown in FIG. 3, when both the first gate driving unit circuit 101 and the second gate driving unit circuit 102 operate normally, and the pixel circuit 200 is not short-circuited, if the pull-up node PUA is at a high level, the first transistor M1A and the second transistor M2A are both turned on, and the clock signal terminal CLKA, on one hand, provides the output signal to the first output terminal G_OUTA via the second transistor M2A, thereby providing the gate signal to the transistor T11 of the pixel circuit 200; on the other hand, provides the output signal to the second output terminal OUT_CA via the first transistor M1A, to provide the corresponding reset signal to the previous-level gate driving unit circuit of the first gate driving unit circuit 101 and the corresponding input signal to the next-level gate driving unit circuit of the first gate driving unit circuit 101. At the same time, since the dual-side simultaneous driving method is adopted, the voltage of the pull-up node PUB is also at the high level, in which case the first transistor M1B and the second transistor M2B are both turned on, and the clock signal terminal CLKB, on one hand, provides the output signal to the first output terminal G_OUTB via the second transistor M2B, thereby providing the gate signal to the transistor T11 of the pixel circuit 200; on the other hand, provides the output signal to the second output terminal OUT_CB via the first transistor M1B, to provide the corresponding reset signal to the previous-level gate driving unit circuit of the second gate driving unit circuit 102 and the corresponding input signal to the next level gate driving unit circuit of the second gate driving unit circuit 102.

When the pixel circuit 200 is short circuited, for example, a gate of the transistor T11 is short-circuited with aground terminal Vcom of the pixel electrode, the gate signal of the pixel circuit 200 is pulled down. Since the first output terminal G_OUTA and the second output terminal OUT_CA are separated by the upper and lower plates of the first capacitor CIA, the output of the second output terminal OUT_CA is not affected by the short circuit, and thus normal output of the upper and lower level gate driving unit circuits of the first gate driving unit circuit 101 is not affected. Similarly, since the first output terminal G_OUTB and the second output terminal OUT_CB are separated by the upper and lower plates of the first capacitor C1B, the output of the second output terminal OUT_CB is not affected by the short circuit, and thus normal output of the upper and lower level gate driving unit circuits of the second gate driving unit circuit 102 is not affected. Therefore, the short-circuit fault is limited to the gate driving unit circuit in the current row, and does not affect the upper and lower level gate driving unit circuits.

When the pixel circuit 200 is not short circuited, and one of the first and second gate driving unit circuits 101 and 102 does not operate normally, in case of assuming that the first gate driving unit circuit 101 does not operate normally and no signal is output from the first gate driving unit circuit 101, the second gate driving unit circuit 102 will have normal output to ensure the normal display of the current row. That is, the second gate driving unit circuit 102 provides the gate signal to the transistor T11 of the pixel circuit 200 via the first output terminal G_OUTB under the control of the voltage of the pull-up node PUB, so that the transistor T11 can be normally turned on. At the same time, after the gate signal passes through the gate line and the first capacitor CIA of the first gate driving unit circuit 101, the voltage at the second output terminal OUT_CA is pulled up due to the bootstrap and the coupling effect of the first capacitor CIA, thereby replacing the normal output signal from the first gate driving unit circuit 101 to provide the reset signal to the previous level gate driving unit circuit of the first gate driving unit circuit 101 and the input signal to the next level gate driving unit circuit of the first gate driving unit circuit 101, so that other gate driving unit circuits on the side of the faulted first gate driving unit circuit 101 can output signals normally. Similarly, when a fault occurs in the second gate driving unit circuit 102, the operation thereof is the same as that when a fault occurs in the first gate driving unit circuit 101, and detailed description there of is omitted herein. In the case of assuming that a fault occurs in the first gate driving unit circuit 101 so that the second output sub-circuit 20 of the first gate driving unit circuit 101 outputs normal signal while the first output sub-circuit 10 of the first gate driving unit circuit 101 outputs no signal, the output signal of the second output sub-circuit 20 may be coupled to the second output terminal OUT_CA via the first capacitor CIA.

Thereby, by connecting upper and lower plates of the first capacitor C1 to the first output terminal and the second output terminal of the gate driving unit circuit, respectively, one can achieve the following: when a fault occurs to a gate driving unit circuit on one side resulting in no signal output from the second output terminal, utilizing the bootstrap and coupling effect of the capacitor, the output signal from the gate driving unit circuit on the opposite side or the output signal from the second output sub-circuit on the present side is imported into the input terminal of the next level gate driving unit circuit and the reset terminal RST_PU of the previous level gate driving unit circuit on the present side, enabling the upper and lower level gate driving unit circuits on the present side to output signals normally. At the same time, the isolation effect of the capacitor is utilized to effectively avoid the influence of short circuit in the panel on the output signal of the second output terminal OUT_C of the gate driving unit circuit, so that the gate driving unit circuit pair can avoid being affected by the short circuit fault in the pixel circuit, and moreover, when there is no signal output from agate driving unit circuit on one side, the integrity of upper and lower cascade connections on this side can be maintained.

Figure 4:
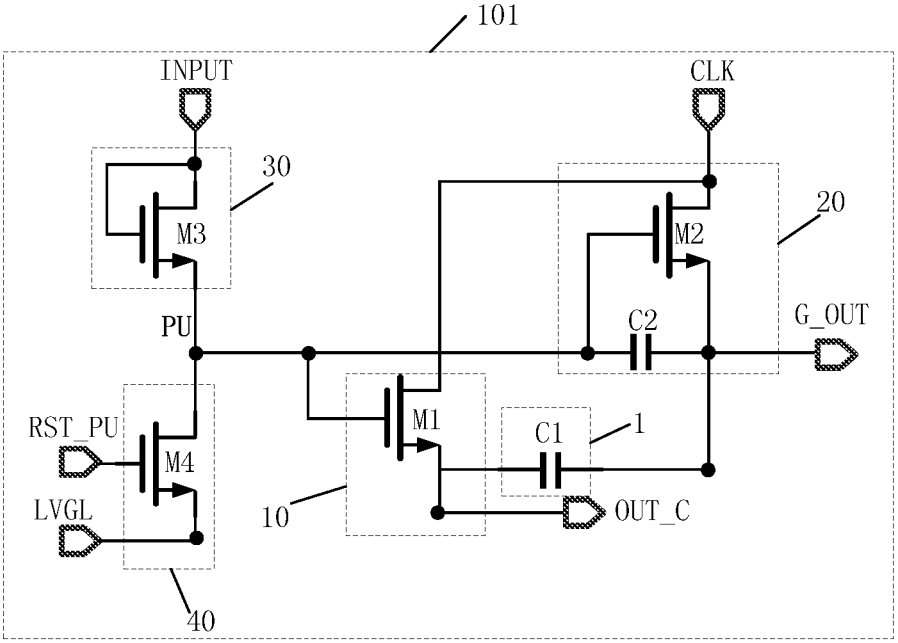
FIG. 4 is a schematic diagram of a structure of one gate driving unit circuit in a gate driving unit circuit pair according to one embodiment of the present disclosure.

According to a specific embodiment of the present disclosure, as shown in FIG. 4, the input sub-circuit 30 may include a third transistor M3. A first terminal and a control terminal of the third transistor M3 are respectively coupled to the input terminal INPUT, and a second terminal of the third transistor M3 is coupled to the pull-up node PU. The reset sub-circuit 40 may include a fourth transistor M4. A control terminal of the fourth transistor M4 is coupled to the reset terminal RST_PU, a first terminal of the fourth transistor M4 is coupled to the pull-up node PU, and a second terminal of the fourth transistor M4 is coupled to the first preset power supply terminal LVGL.

Specifically, as shown in FIG. 4, when the gate driving unit circuit operates normally, if the input signal provided from the input terminal INPUT is at a high level, the third transistor M3 is turned on to charge the pull-up node PU, so that the voltage at the pull-up node PU becomes the high level. At this time, the first transistor M1 and the second transistor M2 are both turned on. On one hand, the clock signal provided by the clock signal terminal CLK provides the output signal to the first output terminal G_OUT via the second transistor M2, thereby providing the gate signal to the pixel circuit 200; on the other hand, the clock signal provided by the clock signal terminal CLK provides the output signal to the second output terminal OUT_C via the first transistor M1, to provide corresponding reset signal to the previous level gate driving unit circuit and corresponding input signal to the next level gate driving unit circuit. When the reset signal provided from the reset terminal RST_PU is at a high level, the fourth transistor M4 is turned on to discharge the pull-up node PU, so that the first transistor M1 and the second transistor M2 are both turned off, and the first output terminal G_OUT and the second output terminal OUT_C stop outputting signal.

When agate driving unit circuit on one side fails to operate normally, it can be seen from the foregoing analysis that the gate driving unit circuit on the opposite side provides a gate signal to the pixel circuit 200. At the same time, after the gate signal passes through the gate line and the first capacitor C1 of the gate driving unit circuit on the faulted side, the voltage at the second output terminal OUT_C is pulled up due to the bootstrap and coupling effect of the capacitor, thereby turning on the fourth transistor M4 of the previous level gate driving unit circuit and the third transistor M3 of the next level gate driving unit circuit, and charging the pull-up node PU of the next level gate driving unit circuit, so that the voltage at the pull-up node PU of the next level gate driving unit circuit is pulled up. Thereby, the gate driving unit circuit on the opposite side replaces the gate driving unit circuit on the faulted side to output signals to the upper and lower level gate driving unit circuits, so that the upper and lower level gate driving unit circuits can output signal normally.

According to a capacitance coupling calculation formula, under the condition of ignoring the overlap capacitance of the transistor, the voltage $\Delta V_C$ at the second output terminal OUT_C is:

$$\Delta V_C = \frac{C_1}{C_1 + C_2} \times \Delta V_G, \tag{1}$$

where $C_1$ is a capacitance value of the first capacitor C1; $C_2$ is a capacitance value of the second capacitor C2; and $\Delta V_G$ is a pulse voltage amplitude output by the first gate driving unit circuit and the second gate driving unit circuit in the gate driving unit circuit pair, that is, a voltage difference between a pulse voltage value and anon-pulse voltage value of the clock signal.

Further, since the reset signal is provided to the previous level gate driving unit circuit and the input signal is provided to the next level gate driving unit circuit via the second output terminal OUT_C, the fourth transistor M4 of the previous level gate driving unit circuit is turned on and the third transistor M3 of the next level gate driving unit circuit is turned on. Therefore, the voltage at the second output terminal OUT_C pulled up by capacitance coupling effect of the first capacitor C1, should be sufficiently high to arrive at turn-on voltages of the fourth transistor M4 and the third transistor M3, ensuring that the fourth transistor M4 and the third transistor M3 can be turned on normally. Therefore, the capacitance value of the first capacitor C1 should meet the following condition:

$$\frac{C_1}{C_1 + C_2} \times \Delta V_G - V_{LVGL} \geq \max(V_{th}(M3), V_{th}(M4)), \quad (2)$$

where $C_1$ is the capacitance value of the first capacitor C1, $C_2$ is the capacitance value of the second capacitor C2, $\Delta V_G$ is the pulse voltage amplitude output by the first gate driving unit circuit and the second gate driving unit circuit in the gate driving unit circuit pair, $V_{LVGL}$ is the voltage of the first preset power supply terminal, $V_{th}$(M3) is the turn-on voltage of the third transistor M3, and $V_{th}$(M4) is the turn-on voltage of the fourth transistor M4.

Figure 5:
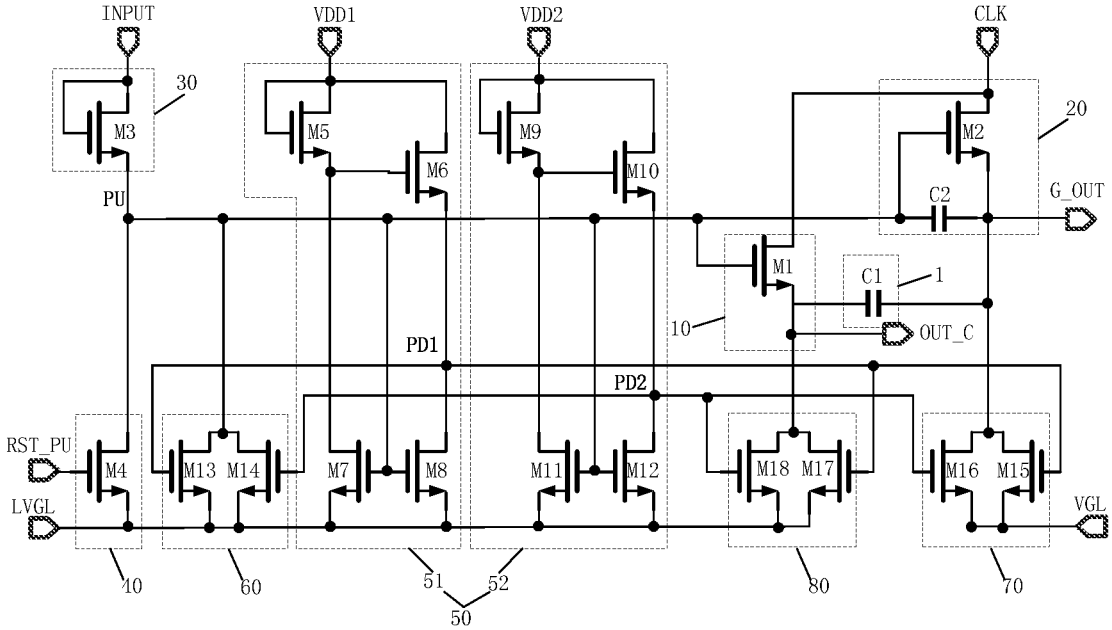
FIG. 5 is a schematic diagram of a structure of one gate driving unit circuit in a gate driving unit circuit pair according to another embodiment of the present disclosure.

According to one embodiment of the present disclosure, as shown in FIG. 5, each of the first gate driving unit circuit 101 and the second gate driving unit circuit 102 further includes a noise control sub-circuit 50, a first de-noising sub-circuit 60, a first noise reduction control terminal VDD1 and a second noise reduction control terminal VDD2. The noise control sub-circuit 50 and the first de-noising sub-circuit 60 are coupled to a first pull-down node PD1 via a branch path, and the noise control sub-circuit 50 and the first de-noising sub-circuit 60 are coupled to a second pull-down node PD2 via another branch path. The first pull-down node PD1 is different from the second pull-down node PD2.

The noise control sub-circuit 50 is respectively coupled to the first noise reduction control terminal VDD1, the first pull-down node PD1, the second noise reduction control terminal VDD2, the second pull-down node PD2, and the first preset power supply terminal LVGL, and is configured to pull up a voltage of the first pull-down node PD1 according to a first noise reduction signal provided by the first noise reduction control terminal VDD1 and to pull up a voltage of the second pull-down node PD2 according to a second noise reduction signal provided by the second noise reduction control terminal VDD2.

The first de-noising sub-circuit 60 is coupled respectively to the pull-up node PU, the first pull-down node PD1, the second pull-down node PD2, and the first preset power supply terminal LVGL, and is configured to, under voltage control of at least one of the first pull-down node PD1 and the second pull-down node PD2, de-noise the voltage at the pull-up node PU via the voltage provided by the first preset power supply terminal LVGL.

The voltage at the pull-up node PU can be de-noised by the voltage provided by the first preset power supply terminal LVGL by setting the noise control sub-circuit 50 and the first de-noising sub-circuit 60.

According to one embodiment of the present disclosure, as shown in FIG. 5, each of the first gate driving unit circuit 101 and the second gate driving unit circuit 102 further includes a second de-noising sub-circuit 70 and a second preset power supply terminal VGL. The second de-noising sub-circuit 70 is respectively coupled to the first output terminal G_OUT, the first pull-down node PD1, the second pull-down node PD2, and the second preset power supply terminal VGL, and is configured to, under voltage control of at least one of the first pull-down node PD1 and the second pull-down node PD2, de-noise the output signal at the first output terminal G_OUT via a voltage provided by the second preset power supply terminal VGL.

The output signal at the first output terminal G_OUT can be de-noised by the voltage provided by the second preset power supply terminal VGL, by setting the noise control sub-circuit 50 and the second de-noising sub-circuit 70.

According to one embodiment of the present disclosure, as shown in FIG. 5, each of the first gate driving unit circuit 101 and the second gate driving unit circuit 102 further includes a third de-noising sub-circuit 80. The third de-noising sub-circuit 80 is respectively coupled to the second output terminal OUT_C, the first pull-down node PD1, the second pull-down node PD2, and the first preset power supply terminal LVGL, and is configured to, under voltage control of at least one of the first pull-down node PD1 and the second pull-down node PD2, de-noise the output signal at the second output terminal OUT_C via the voltage provided by the first preset power supply terminal LVGL.

The output signal at the second output terminal OUT_C can be de-noised by the voltage provided by the first preset power supply terminal LVGL, by setting the noise control sub-circuit 50 and the third de-noising sub-circuit 80.

According to one embodiment of the present disclosure, as shown in FIG. 5, the noise control sub-circuit 50 may include a first noise control sub-circuit 51 and a second noise control sub-circuit 52. The first noise control sub-circuit 51 includes a fifth transistor M5, a sixth transistor M6, a seventh transistor M7, and an eighth transistor M8. A first terminal and a control terminal of the fifth transistor M5 are respectively coupled to the first noise reduction control terminal VDD1. A control terminal of the sixth transistor M6 is coupled to a second terminal of the fifth transistor M5, a first terminal of the sixth transistor M6 is coupled to the first noise reduction control terminal VDD1, and a second terminal of the sixth transistor M6 is coupled to the first pull-down node PD1. A first terminal of the seventh transistor M7 is coupled to the second terminal of the fifth transistor M5, and a second terminal of the seventh transistor M7 is coupled to the first preset power supply terminal LVGL. A first terminal of the eighth transistor M8 is coupled to the first pull-down node PD1, a second terminal of the eighth transistor M8 is coupled to the first preset power supply terminal LVGL, and a control terminal of the eighth transistor M8 is coupled to a control terminal of the seventh transistor M7 and the pull-up node PU.

The second noise control sub-circuit 52 may include a ninth transistor M9, a tenth transistor M10, an eleventh transistor M11, and a twelfth transistor M12. A first terminal and a control terminal of the ninth transistor M9 are respectively coupled to the second noise reduction control terminal VDD2. A control terminal of the tenth transistor M10 is coupled to a second terminal of the ninth transistor M9, a first terminal of the tenth transistor M10 is coupled to the second noise reduction control terminal VDD2, and a second terminal of the tenth transistor M10 is coupled to the second pull-down node PD2. A first terminal of the eleventh transistor M11 is coupled to the second terminal of the ninth transistor M9, and a second terminal of the eleventh transistor M11 is coupled to the first preset power supply terminal LVGL. A first terminal of the twelfth transistor M12 is coupled to the second pull-down node PD2, a second terminal of the twelfth transistor M12 is coupled to the first preset power supply terminal LVGL, and a control terminal of the twelfth transistor M12 is coupled to a control terminal of the eleventh transistor M11 and the pull-up node PU.

Specifically, the noise control sub-circuit 50 may include two noise control sub-circuits, the first noise control sub-circuit 51 and the second noise control sub-circuit 52. The de-noising control is performed by the two noise control sub-circuits. When the pull-up node PU is at a high level, both the eighth transistor M8 and the twelfth transistor M12 are turned on, both the first pull-down node PD1 and the second pull-down node PD2 are at a low level, in which case the first de-noising sub-circuit 60, the second de-noising sub-circuit 70 and the third de-noising sub-circuit 80 do not perform de-noising process on the voltage at the pull-up node PU, the output signal at the first output terminal G_OUT, and the output signal at the second output terminal OUT_C. At the same time, the seventh transistor M7 is turned on, and the control terminal of the sixth transistor M6 is at a low level, in which case even if the first noise reduction signal provided by the first noise reduction control terminal VDD1 is at a high level, it is still ensured that the sixth transistor M6 is turned off by setting a reasonable width-to-length ratio. Similarly, the eleventh transistor M11 is also turned on, and the control terminal of the tenth transistor M10 is at a low level, in which case even if the second noise reduction signal provided by the second noise reduction control terminal VDD2 is at a high level, it is still ensured that the tenth transistor M10 is turned off by setting a reasonable width-to-length ratio.

When the pull-up node PU is at a low level, both the seventh transistor M7 and the eighth transistor M8 are turned off. When the first noise reduction signal provided by the first noise reduction control terminal VDD1 is a the high level, both the fifth transistor M5 and the sixth transistor M6 are turned on, and the first pull-down node PD1 is at a high level. At this time, the first de-noising sub-circuit 60, the second de-noising sub-circuit 70, and the third de-noising sub-circuit 80 perform de-noising process on the voltage at the pull-up node PU, the output signal of the first output terminal G_OUT, and the output signal of the second output terminal OUT_C. At the same time, both the eleventh transistor M11 and the twelfth transistor M12 are turned off. When the second noise reduction signal provided by the second noise reduction control terminal VDD2 is at a high level, both the ninth transistor M9 and the tenth transistor M10 are turned on, and the second pull-down node PD2 is at a high level. At this time, the first de-noising sub-circuit 60, the second de-noising sub-circuit 70 and the third de-noising sub-circuit 80 perform de-noising process on the voltage of the pull-up node PU, the output signal of the first output terminal G_OUT, and the output signal of the second output terminal OUT_C.

According to one embodiment of the present disclosure, as shown in FIG. 5, the first de-noising sub-circuit 60 may include a thirteenth transistor M13 and a fourteenth transistor M14. A control terminal of the thirteenth transistor M13 is coupled to the first pull-down node PD1, a first terminal of the thirteenth transistor M13 is coupled to the pull-up node PU, and a second terminal of the thirteenth transistor M13 is coupled to the first preset power supply terminal LVGL. A control terminal of the fourteenth transistor M14 is coupled to the second pull-down node PD2, a first terminal of the fourteenth transistor M14 is coupled to the pull-up node PU, and a second terminal of the fourteenth transistor M14 is coupled to the first preset power supply terminal LVGL.

Specifically, in combination with the noise control sub-circuit 50, when the pull-up node PU is at a high level, both the eighth transistor M8 and the twelfth transistor M12 are turned on, and both the first pull-down node PD1 and the second pull-down node PD2 are at a low level, both the thirteenth transistor M13 and the fourteenth transistor M14 are turned off, and in this case the first de-noising sub-circuit 60 does not de-noise the pull-up node PU.

When the pull-up node PU is at a low level, both the seventh transistor M7 and the eighth transistor M8 are turned off. When the first noise reduction signal provided by the first noise reduction control terminal VDD1 is at a high level, both the fifth transistor M5 and the sixth transistor M6 are turned on, and the first pull-down node PD1 is at a high level. At this time, the thirteenth transistor M13 is turned on to maintain the pull-up node PU at the low level, so as to realize de-noising of the pull-up node PU, and ensure that the first transistor M1 and the second transistor M2 are turned off, so that the output signal of the first output terminal G_OUT and the output signal of the second output terminal OUT_C do not crosstalk with the clock signal provided by the clock signal terminal CLK. At the same time, both the eleventh transistor M11 and the twelfth transistor M12 are turned off. When the second noise reduction signal provided by the second noise reduction control terminal VDD2 is at a high level, both the ninth transistor M9 and the tenth transistor M10 are turned on and the second pull-down node PD2 is at a high level. At this time, the fourteenth transistor M14 is turned on, so that the pull-up node PU is always at the low level, so as to realize de-noising of the pull-up node PU, and ensure that the first transistor M1 and the second transistor M2 are turned off, so that the output signal of the first output terminal G_OUT and the output signal of the second output terminal OUT_C do not crosstalk with the clock signal provided by the clock signal terminal CLK.

According to one embodiment of the present disclosure, as shown in FIG. 5, the second de-noising sub-circuit 70 may include a fifteenth transistor M15 and a sixteenth transistor M16. A control terminal of the fifteenth transistor M15 is coupled to the first pull-down node PD1, a first terminal of the fifteenth transistor M15 is coupled to the first output terminal G_OUT, and a second terminal of the fifteenth transistor M15 is coupled to the second preset power supply terminal VGL. A control terminal of the sixteenth transistor M16 is coupled to the second pull-down node PD2, a first terminal of the sixteenth transistor M16 is coupled to the first output terminal G_OUT, and a second terminal of the sixteenth transistor M16 is coupled to the second preset power supply terminal VGL.

Specifically, in combination with the noise control sub-circuit 50, when the pull-up node PU is at a high level, both the eighth transistor M8 and the twelfth transistor M12 are turned on, both the first pull-down node PD1 and the second pull-down node PD2 are at a low level, and both the fifteenth transistor M15 and the sixteenth transistor M16 are turned off. At this time, the second de-noising sub-circuit 70 does not de-noise the output signal of the first output terminal G_OUT.

When the pull-up node PU is at a low level, both the seventh transistor M7 and the eighth transistor M8 are turned off. When the first noise reduction signal provided by the first noise reduction control terminal VDD1 is at a high level, the fifth transistor M5 and the sixth transistor M6 are turned on, and the first pull-down node PD1 is at a high level. At this time, the fifteenth transistor M15 is turned on, so that the output signal of the first output terminal G_OUT is always at a low level. This realizes de-noising of the output signal of the first output terminal G_OUT, so that the output signal of the first output terminal G_OUT does not crosstalk with the clock signal provided by the clock signal terminal CLK. At the same time, both the eleventh transistor M11 and the twelfth transistor M12 are turned off. When the second noise reduction signal provided by the second noise reduction control terminal VDD2 is at a high level, both the ninth transistor M9 and the tenth transistor M10 are turned on, and the second pull-down node PD2 is at a high level. At this time, the sixteenth transistor M16 is turned on, so that the output signal of the first output terminal G_OUT is always at the low level. This realizes de-noising of the output signal of the first output terminal G_OUT, so that the output signal of the first output terminal G_OUT does not crosstalk with the clock signal provided by the clock signal terminal CLK.

According to one embodiment of the present disclosure, as shown in FIG. 5, the third de-noising sub-circuit 80 may include a seventeenth transistor M17 and an eighteenth transistor M18. A control terminal of the seventeenth transistor M17 is coupled to the first pull-down node PD1, a first terminal of the seventeenth transistor M17 is coupled to the second output terminal OUT_C, and a second terminal of the seventeenth transistor M17 is coupled to the first preset power supply terminal LVGL. A control terminal of the eighteenth transistor M18 is coupled to the second pull-down node PD2, a first terminal of the eighteenth transistor M18 is coupled to the second output terminal OUT_C, and a second terminal of the eighteenth transistor M18 is coupled to the first preset power supply terminal LVGL.

Specifically, in combination with the noise control sub-circuit 50, when the pull-up node PU is at a high level, both the eighth transistor M8 and the twelfth transistor M12 are turned on, both the first pull-down node PD1 and the second pull-down node PD2 are at a low level, and both the seventeenth transistor M17 and the eighteenth transistor M18 are turned off. At this time, the third de-noising sub-circuit 80 does not de-noise the output signal of the second output terminal OUT_C.

When the pull-up node PU is at a low level, both the seventh transistor M7 and the eighth transistor M8 are turned off. When the first noise reduction signal provided by the first noise reduction control terminal VDD1 is at a high level, the fifth transistor M5 and the sixth transistor M6 are turned on, and the first pull-down node PD1 is at a high level. At this time, the seventeenth transistor M17 is turned on, so that the output signal of the second output terminal OUT_C is always at a low level. This realizes de-noising of the output signal of the second output terminal OUT_C, so that the output signal of the second output terminal OUT_C does not crosstalk with the clock signal provided by the clock signal terminal CLK. At the same time, both the eleventh transistor M11 and the twelfth transistor M12 are turned off. When the second noise reduction signal provided by the second noise reduction control terminal VDD2 is at a high level, both the ninth transistor M9 and the tenth transistor M10 are turned on and the second pull-down node PD2 is at a high level. At this time, the eighteenth transistor M18 is turned on, so that the output signal of the second output terminal OUT_C is always at the low level. This realizes de-noising of the output signal of the second output terminal OUT_C, so that the output signal of the second output terminal OUT_C does not crosstalk with the clock signal provided by the clock signal terminal CLK.

Figure 6:
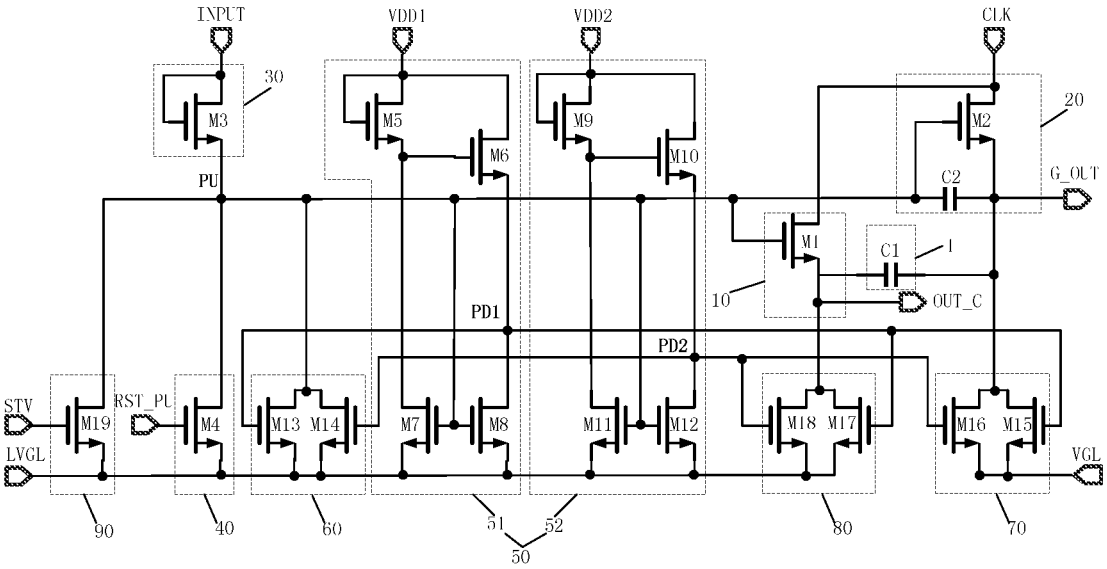
FIG. 6 is a schematic diagram of a structure of one gate driving unit circuit in a gate driving unit circuit pair according to still another embodiment of the present disclosure.

According to one embodiment of the present disclosure, as shown in FIG. 6, each of the first gate driving unit circuit 101 and the second gate driving unit circuit 102 further includes a discharge sub-circuit 90 and a frame start terminal STY. The discharge sub-circuit 90 is coupled to the frame start terminal STV, the pull-up node PU, and the first preset power supply terminal LVGL, and is configured to pull down the voltage of the pull-up node PU via the voltage provided by the first preset power supply terminal LVGL under a control of a frame start signal provided by the frame start terminal STY.

According to a specific embodiment of the present disclosure, as shown in FIG. 6, the discharge sub-circuit 90 may include a nineteenth transistor M19. A control terminal of the nineteenth transistor M19 is coupled to the frame start terminal STV, a first terminal of the nineteenth transistor M19 is coupled to the pull-up node PU, and a second terminal of the nineteenth transistor M19 is coupled to the first preset power supply terminal LVGL.

Specifically, at a start time of the display of a frame of screen, the frame start terminal STV provides a high level signal, and at this time, the nineteenth transistor M19 is turned on, to discharge the pull-up node PU.

It should be noted that, in the foregoing embodiments, the first to nineteenth transistors M1 to M19 are NMOS transistors, and in other embodiments of the present disclosure, the first to nineteenth transistors M1 to M19 may also be PMOS transistors. The type of specific transistors is not limited here.

The gate driving unit circuit pair according to an embodiment of the present disclosure includes the first gate driving unit circuit and the second gate driving unit circuit. The first gate driving unit circuit and the second gate driving unit circuit are configured to drive the same pixel circuit simultaneously, and each of them includes the coupling and isolation sub-circuit 1 disposed between the first output terminal G_OUT and the second output terminal OUT_C. The gate driving unit circuit pair, via the isolation effect, bootstrap and coupling effect of the coupling and isolation sub-circuit 1, not only can avoid being affected by short circuit fault occurred in the pixel circuit, but also, when there is no signal output from agate driving unit circuit on one side, can maintain the integrity of upper and lower cascade connections on this side.

Figure 7:
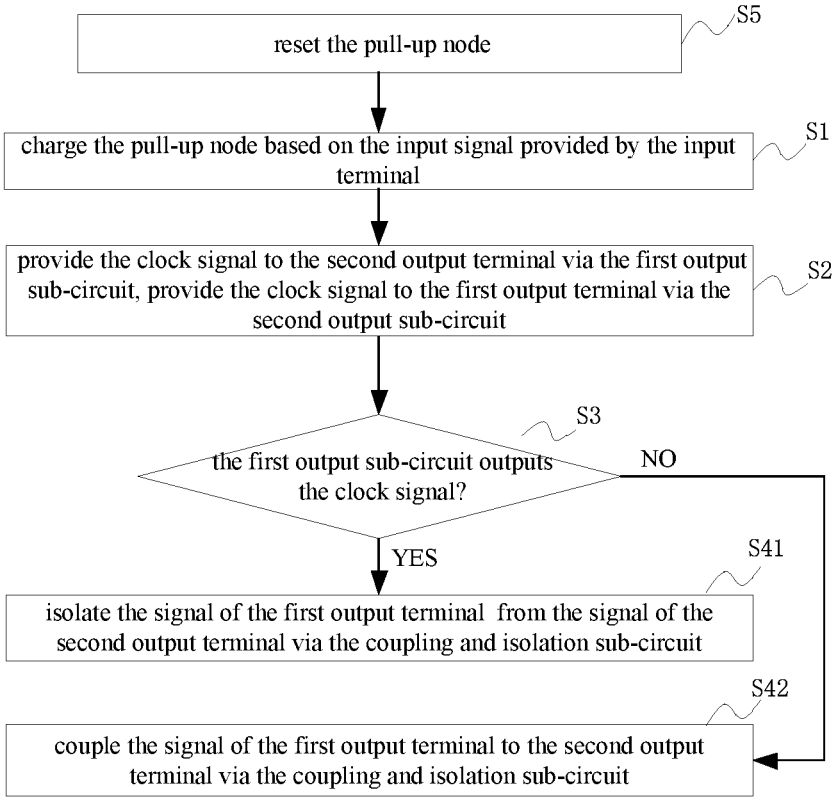
FIG. 7 is a flowchart of a driving method of a gate driving unit circuit pair according to one embodiment of the present disclosure.

FIG. 7 is a flowchart of a driving method of a gate driving unit circuit pair according to an embodiment of the present disclosure. The driving method is used to drive the gate driving unit circuit pair described above, and includes the following steps.

In step S1, via the input sub-circuit 30, the input signal provided by the input terminal INPUT is input to the pull-up node PU, to charge the pull-up node.

In step S2, under the voltage control of the pull-up node PU, the clock signal provided by the clock signal terminal CLK is output and provided to the second output terminal OUT_C, via the first output sub-circuit 10; and the clock signal provided by the clock signal terminal CLK is output and provided to the first output terminal G_OUT, via the second output sub-circuit 20.

In step S3, it is judged whether or not the first output sub-circuit 10 outputs a clock signal, if yes, the method goes to step S41; and if no, it goes to step S42.

In step S41, when the first output sub-circuit 10 outputs the clock signal, the coupling and isolation sub-circuit 1 isolates the signal of the first output terminal G_OUT from the signal of the second output terminal OUT_C, and the clock signal output by the first output sub-circuit 10 is provided to the second output terminal OUT_C.

In step S42, when the first output sub-circuit 10 does not output the clock signal, the signal of the first output terminal G_OUT is coupled to the second output terminal OUT_C via the coupling and isolation sub-circuit 1.

In step S5, under the control of the reset signal provided by the reset terminal RST_PU, the pull-up node PU is reset by the voltage provided by the first preset power supply terminal LVGL.

Specifically, when the pixel circuit is short circuited pulling down the gate signal of the pixel circuit, each of the first gate driving unit circuit 101 and the second gate driving unit circuit 102 can output the clock signal via its first output sub-circuit 10, isolate the signal of the first output terminal G_OUT from the signal of the second output terminal OUT_C via its own first capacitor C1, and provide the clock signal output by its first output sub-circuit 10 to its second output terminal OUT_C.

When one of the first and second gate driving unit circuits 101 and 102 fails to operate normally causing the second output terminal OUT_C of the faulted gate driving unit circuit to have no output signal, the signal of its first output G_OUT is coupled to its second output OUT_C by the first capacitor C1. At this time, the signal at the first output terminal G_OUT may be one of the following: a clock signal output by the second sub-circuit of the faulted gate driving unit circuit; and a clock signal output by the second sub-circuit of the other one of the first and second gate driving unit circuits 101 and 102 that is not faulted. For example, when the first output sub-circuit 10 of the first gate driving unit circuit 101 does not output clock signal, the signal at the first output terminal G_OUT of the first gate driving unit circuit 101 is: a clock signal output by the second output sub-circuit of the first gate driving unit circuit 101: or a clock signal output by the second output sub-circuit of the second gate driving unit circuit 102.

The gate signal is provided to the pixel circuit via the first output terminal of the un-faulted gate driving unit circuit, and due to the bootstrap and coupling effect of the first capacitor C1 of the faulted gate driving unit circuit, the output signal at the second output terminal of the faulted gate driving unit circuit is pulled up, to provide a reset signal to corresponding previous level gate driving unit circuit and provide an input signal to corresponding next level gate driving unit circuit. When the second output sub-circuit of the faulted gate driving unit circuit outputs the gate signal, the gate signal output by the second output sub-circuit thereof may be coupled to the second output terminal thereof by the bootstrap and coupling effect of the first capacitor C1.

When both the first gate driving unit circuit and the second gate driving unit circuit operate normally and the pixel circuit does not have a short circuit fault, under the voltage control of the pull-up node, the first output terminal provides the gate signal to the pixel circuit, and the second output terminal provides the reset signal to the previous level gate driving unit circuit and the input signal to the next level driving unit circuit.

It should be noted that, for any details not disclosed about the driving method for the gate driving unit circuit pair of the embodiments of the present disclosure, one may refer to the details disclosed about the gate driving unit circuit pair of the embodiments of the present disclosure, which are not described again herein.

According to the driving method for the gate driving unit circuit pair of the embodiments of the present disclosure, the pull-up node PU is charged according to the input signal provided by the input terminal INPUT. When the pixel circuit has a short circuit fault so that the gate signal of the pixel circuit is pulled down, the output signal of the second output terminal OUT_C is not affected due to the isolation effect of the first capacitor C1. When one of the two gate driving unit circuits fails to operate normally so that the first output terminal G_OUT and the second output terminal OUT_C of the faulted gate driving unit circuit have no output signal, the gate signal is provided to the pixel circuit via the first output terminal G_OUT of the un-faulted gate driving unit circuit. And under the bootstrap and coupling effect of the first capacitor C1, the output signal at the second output terminal OUT_C of the faulted gate driving unit circuit is pulled up, to provide the reset signal to corresponding previous level gate driving unit circuit and the input signal to the next level gate driving unit circuit. As such, by the isolation effect, bootstrap effect, and coupling effect of the first capacitor C1, the gate driving unit circuit can not only be prevented from being affected by short circuit fault occurring in the pixel circuit, but also, when there is no signal output from the gate driving unit circuit, maintain the integrity of upper and lower cascade connections. When one of the two gate driving unit circuits fails to operate normally so that the second output sub-circuit of the faulted gate driving unit circuit can output signal and the first output sub-circuit of the faulted gate driving unit circuit cannot output signal, the output signal from the second output sub-circuit can be coupled to the second output OUT_C thereof via the first capacitor C1.

Figure 8:
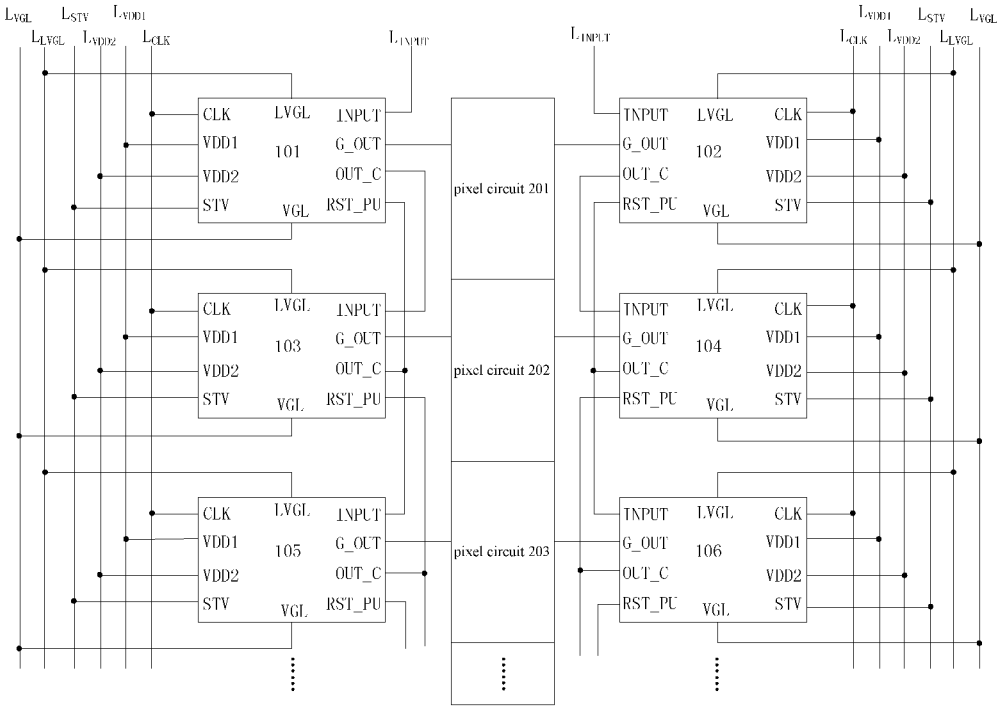
FIG. 8 is a schematic diagram of a structure of a gate driving circuit according to one embodiment of the present disclosure.

FIG. 8 is a schematic diagram of a structure of a gate driving circuit according to one embodiment of the present disclosure. As shown in FIG. 8, the gate driving circuit may include a plurality of the gate driving unit circuit pairs described above, a start signal line $L_{INPUT}$, a clock signal line $L_{CLK}$, a first noise reduction control line $L_{VDD1}$, a second noise reduction control line $L_{VDD2}$, a frame start signal line $L_{STV}$, a first preset power supply line $L_{LVGL}$, and a second preset power supply line $L_{VGL}$.

As shown in FIG. 8, the input terminal of the first gate driving unit circuit in theist gate driving unit circuit pair is coupled to the start signal line, the second output terminal of the first gate driving unit circuit in the 1st gate driving unit circuit pair is coupled to the input terminal of the first gate driving unit circuit in the 2nd gate driving unit circuit pair, and the second output terminal of the first gate driving unit circuit in an i-th gate driving unit circuit pair is coupled to the reset terminal of the first gate driving unit circuit in an (i−1)-th gate driving unit circuit pair and the input terminal of the first gate driving unit circuit in an (i+1)-th gate driving unit circuit pair respectively, wherein i is a positive integer greater than 1.

The input terminal of the second gate driving unit circuit in the 1st gate driving unit circuit pair is coupled to the start signal line, the second output terminal of the second driving circuit unit in the 1st gate level driving unit circuit pair is coupled to the input terminal of the second gate driving unit circuit in the 2nd gate driving unit circuit pair, and the second output terminal of the second gate driving unit circuit in the i-th gate driving unit circuit pair is coupled to the reset terminal of the second gate driving unit circuit in the (i−1)-th gate driving unit circuit pair and the input terminal of the second gate driving unit circuit in the (i+1)-th gate driving unit circuit pair.

The first output terminals of the first and second gate driving unit circuits in each of the gate driving unit circuit pairs are respectively coupled to the gate line of the same pixel circuit. In the first gate driving unit circuit in each of the gate driving unit circuit pairs, the clock signal terminal CLK, the first noise reduction control terminal VDD1, the second noise reduction control terminal VDD2, the frame start terminal STV, the first preset power supply terminal LVGL, and the second preset power supply terminal VGL are coupled to the clock signal line $L_{CLK}$, the first noise reduction control line $L_{VDD1}$, the second noise reduction control line $L_{VDD2}$, the frame start signal line $L_{STV}$, the first preset power supply line $L_{LVGL}$, and the second preset power supply line $L_{VGL}$, respectively. In the second gate driving unit circuit in each of the gate driving unit circuit pairs, the clock signal terminal CLK, the first noise reduction control terminal VDD1, the second noise reduction control terminal VDD2, the frame start terminal STV, the first preset power supply terminal LVGL, and the second preset power supply terminal VGL are coupled to the clock signal line $L_{CLK}$, the first noise reduction control line $L_{VDD1}$, the second noise reduction control line $L_{VDD2}$, the frame start signal line $L_{STV}$, the first preset power supply line $L_{LVGL}$, and the second preset power supply line $L_{VGL}$, respectively.

Specifically, as shown in FIG. 8, both the first output terminal G_OUT of the first gate driving unit circuit 101 of the 1st gate driving unit circuit pair and the first output terminal G_OUT of the second gate driving unit circuit 102 of the 1st gate driving unit circuit pair are coupled to the pixel circuit 201, to simultaneously drive the pixel circuit 201. Both the first output terminal G_OUT of the first gate driving unit circuit 103 of the 2nd gate driving unit circuit pair and the first output terminal G_OUT of the second gate driving unit circuit 104 of the 2nd gate driving unit circuit pair are coupled to the pixel circuit 202, to simultaneously drive the pixel circuit 202. Both the first output terminal G_OUT of the first gate driving unit circuit 105 of the 3rd gate driving unit circuit pair and the first output terminal G_OUT of the second gate driving unit circuit 106 of the 3rd gate driving unit circuit pair are coupled to the pixel circuit 203, to simultaneously drive the pixel circuit 203; and so on, to achieve dual-side simultaneous driving of the pixel circuits.

At the same time, the input terminal INPUT of the first gate driving unit circuit 101 in the 1st gate driving unit circuit pair is coupled to the start signal line $L_{INPUT}$, to provide input signal to the first gate driving unit circuit 101 via the start signal line $L_{INPUT}$. The second output terminal OUT_C of the first gate driving unit circuit 101 of the 1st gate driving unit circuit pair is coupled to the input terminal INPUT of the first gate driving unit circuit 103 of the 2nd gate driving unit circuit pair, to provide input signal to the first gate driving unit circuit 103. The second output terminal OUT_C of the first gate driving unit circuit 103 is coupled to the reset terminal RST_PU of the first gate driving unit circuit 101, to provide reset signal to the first gate driving unit circuit 101. At the same time, the second output terminal OUT_C of the first gate driving unit circuit 103 is coupled to the input terminal INPUT of the first gate driving unit circuit 105 of the 3rd gate driving unit circuit pair, to provide input signal for the first gate driving unit circuit 105, and so on, to achieve cascade of gate driving unit circuits at one side. Further, the input terminal INPUT of the second gate driving unit circuit 102 in the 1st gate driving unit circuit pair is coupled to the start signal line $L_{INPUT}$, to provide input signal to the second gate driving unit circuit 102 via the start signal line $L_{INPUT}$. The second output terminal OUT_C of the second gate driving unit circuit 102 of the 1st gate driving unit circuit pair is coupled to the input terminal INPUT of the second gate driving unit circuit 104 of the 2nd gate driving unit circuit pair, to provide input signal to the second gate driving unit circuit 104. The second output terminal OUT_C of the second gate driving unit circuit 104 is coupled to the reset terminal RST_PU of the second gate driving unit circuit 102, to provide reset signal to the second gate driving unit circuit 102. At the same time, the second output terminal OUT_C of the second gate driving unit circuit 104 is coupled to the input terminal INPUT of the second gate driving unit circuit 106 of the 3rd gate driving unit circuit pair, to provide input signal to the second gate driving unit circuit 106, and so on, to achieve cascade of gate driving unit circuits at the other side. Moreover, the first output terminal G_OUT and the second output terminal OUT_C of each of gate driving unit circuits are separated by the first capacitor C1. Therefore, by adopting dual side simultaneous driving method, and under the effect of the first capacitance C1, the gate driving unit circuits are enabled not only to avoid being affected by short circuit fault occurring in the pixel circuit, but also, when there is no signal output from a gate driving unit circuit on one side, to maintain the integrity of upper and lower cascade connections on this side.

In addition, the clock signal line, the first noise reduction control line, the second noise reduction control line, the frame start signal line, the first preset power supply line, and the second preset power supply line may be shared by the gate driving unit circuits on both sides, or may be provided independently on each side. The number of signal lines can be reduced by sharing, and reliability can be improved by independent usage, and one may determine which specific method to choose according to actual situations.

It should be noted that, for any details not disclosed about the gate driving circuit of the embodiments of the present disclosure, one may refer to the details disclosed about the gate driving unit circuit pair of the embodiments of the present disclosure, which are not described again herein.

The gate driving circuit according to the embodiment of the present disclosure, by using the above-described gate driving unit circuit pair, can not only prevent the gate driving unit circuit from being affected by short circuit fault occurring in the pixel circuit, but also, when there is no signal output from the gate driving unit circuit, maintain the integrity of upper and lower cascade connections, thereby ensuring reliability of operation of the gate driving unit circuit.

Figure 9:
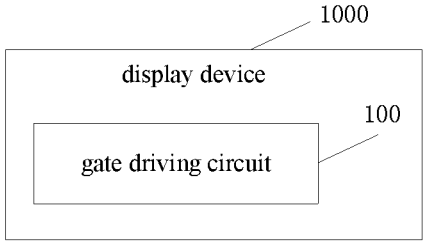
FIG. 9 is a schematic diagram of a display device according to one embodiment of the present disclosure.

FIG. 9 is a schematic diagram of a display device according to one embodiment of the present disclosure. As shown in FIG. 9, the display device 1000 of the embodiment of the present disclosure may include the gate driving circuit 100 described above.

The display device according to the embodiment of the present disclosure, by using the above-described gate driving circuit, can not only prevent the gate driving unit circuit from being affected by short circuit fault occurring in the pixel circuit, but also, when there is no signal output from the gate driving unit circuit, maintain the integrity of upper and lower cascade connections, thereby ensuring reliability of operation of the gate driving unit circuit.

According to one embodiment of the present disclosure, a gate driving unit circuit pair is provided including a first gate driving unit circuit and a second gate driving unit circuit. The first gate driving unit circuit and the second gate driving unit circuit are configured to simultaneously drive the same pixel circuit. As shown in FIG. 6, each of the first gate driving unit circuit 101 and the second gate driving unit circuit 102 includes: a first transistor M1, a second transistor M2, a third transistor M3, a fourth transistor M4, a fifth transistor M5, a sixth transistors M6, a seventh transistor M7, an eighth transistor M8, a ninth transistor M9, a tenth transistor M10, an eleventh transistor M11, a twelfth transistor M12, a thirteenth transistor M13, a fourteenth transistor M14, a fifteenth transistor M15, a sixteenth transistor M16, a seventeenth transistor M17, an eighteenth transistor M18, a nineteenth transistor M19, a first capacitor C1, a second capacitor C2, an input terminal INPUT, a reset terminal RST_PU, a first output terminal G_OUT, a second output terminal OUT_C, a first noise reduction control terminal VDD1, a second noise reduction control terminal VDD2, a first preset power supply terminal LVGL, a second preset power supply terminal VGL, a frame start terminal STV, and a clock signal terminal CLK.

A control terminal of the first transistor M1 is respectively coupled to a control terminal of the second transistor M2, a second terminal of the third transistor M3, a first terminal of the fourth transistor M4, a control terminal of the seventh transistor M7, a control terminal of the eighth transistor M8, a control terminal of the eleventh transistor M11, a control terminal of the twelfth transistor M12, a first terminal of the thirteenth transistor M13, a first terminal of the fourteenth transistor M14, a first terminal of the nineteenth transistor M19 and a first terminal of the second capacitor C2; a first terminal of the first transistor M1 is coupled to the clock signal terminal CLK; and a second terminal of the first transistor M1 is respectively coupled to the second output terminal OUT_C, a first terminal of the first capacitor C1, a first terminal of the seventeenth transistor M17 and a first terminal of the eighteenth transistor M18.

A first terminal of the second transistor M2 is coupled to the clock signal terminal CLK; a second terminal of the second transistor M2 is respectively coupled to the first output terminal G_OUT, a second terminal of the second capacitor C2, a second terminal of the first capacitor C1, a first terminal of the fifteenth transistor M15, and a first terminal of the sixteenth transistor M16.

A first terminal and a control terminal of the third transistor M3 are respectively coupled to the input terminal INPUT.

A control terminal of the fourth transistor M4 is coupled to the reset terminal RST_PU, and a second terminal of the fourth transistor M4 is coupled to the first preset power supply terminal LVGL.

A first terminal and a control terminal of the fifth transistor M5 are respectively coupled to the first noise reduction control terminal VDD1, and a second terminal of the fifth transistor M5 is respectively coupled to a control terminal of the sixth transistor M6 and a first terminal of the seventh transistor M7.

A first terminal of the sixth transistor M6 is coupled to the first noise reduction control terminal VDD1, and a second terminal of the sixth transistor M6 is respectively coupled to a first terminal of the eighth transistor M8, a control terminal of the thirteenth transistor M13, a control terminal of the fifteenth transistor M15 and a control terminal of the seventeenth transistor M17.

A second terminal of the seventh transistor M7 is coupled to the first preset power supply terminal LVGL.

A second terminal of the eighth transistor M8 is coupled to the first preset power supply terminal LVGL.

A first terminal and a control terminal of the ninth transistor M9 are respectively coupled to the second noise reduction control terminal VDD2, and a second terminal of the ninth transistor M9 is respectively coupled to a control terminal of the tenth transistor M10 and a first terminal of the eleventh transistor M11.

A first terminal of the tenth transistor M10 is coupled to the second noise reduction control terminal VDD2, and the second terminal of the tenth transistor M10 is respectively coupled to a first terminal of the twelfth transistor M12, a control terminal of the fourteenth transistor M14, a control terminal of the sixteenth transistor M16, and a control terminal of the eighteenth transistor M18.

A second terminal of the eleventh transistor M11 is coupled to the first preset power supply terminal LVGL.

A second terminal of the twelfth transistor M12 is coupled to the first preset power supply terminal LVGL.

A second terminal of the thirteenth transistor M13 is coupled to the first preset power supply terminal LVGL.

A second terminal of the fourteenth transistor M14 is coupled to the first preset power supply terminal LVGL.

A second terminal of the fifteenth transistor M15 is coupled to the second preset power supply terminal VGL.

A second terminal of the sixteenth transistor M16 is coupled to the second preset power supply terminal VGL.

A second terminal of the seventeenth transistor M17 is coupled to the first preset power supply terminal LVGL.

A second terminal of the eighteenth transistor M18 is coupled to the first preset power supply terminal LVGL.

A control terminal of the nineteenth transistor M19 is coupled to the frame start terminal STV, and a second terminal of the nineteenth transistor M19 is coupled to the first preset power supply terminal LVGL.

The first output terminal G_OUT of the first gate driving unit circuit 101 is coupled to the first output terminal G_OUT of the second gate driving unit circuit 102 to drive the same pixel circuit 200 simultaneously.

The control terminal of the first transistor M1, the control terminal of the second transistor M2, the second terminal of the third transistor M3, the first terminal of the fourth transistor M4, the control terminal of the seventh transistor M7, the control terminal of the eighth transistor M8, the control terminal of the eleventh transistor M11, the control terminal of the twelfth transistor M12, the first terminal of the thirteenth transistor M13, the first terminal of the fourteenth transistor M14, the first terminal of the nineteenth transistor M19, and the first terminal of the second capacitor C2 are coupled to a pull-up node PU.

The second terminal of the sixth transistor M6, the first terminal of the eighth transistor M8, the control terminal of the thirteenth transistor M13, the control terminal of the fifteenth transistor M15, and the control terminal of the seventeenth transistor M17 are coupled to a first pull-down node PD1.

The second terminal of the tenth transistor M10, the first terminal of the twelfth transistor M12, the control terminal of the fourteenth transistor M14, the control terminal of the sixteenth transistor M16, and the control terminal of the eighteenth transistor M18 are coupled to the second pull-down node PD2.

By using the above-described gate driving unit circuit pair, one can not only prevent the gate driving unit circuit from being affected by short circuit fault occurring in the pixel circuit, but also, when there is no signal output from the gate driving unit circuit, maintain the integrity of upper and lower cascade connections, thereby ensuring reliability of operation of the gate driving unit circuit.

In the description of the present disclosure, the terms "first" and "second" are used for descriptive purposes only, and are not to be construed as indicating or implying relative importance or implicitly designating the number of technical features indicated. Thus, features defined as "first" or "second" may include at least one of the features, either explicitly or implicitly. In the description of the present disclosure, the meaning of "a plurality" is at least two, such as two, three, etc., unless specifically defined otherwise.

In the description of the present specification, the description with reference to the terms "one embodiment", "some embodiments", "example", "specific example", or "some examples" and the like means a specific feature, a structure, a material, or characteristics described in connection with the embodiment or example are included in at least one embodiment or example of the present disclosure. In the present specification, the schematic representation of the above terms is not necessarily directed to the same embodiment or example. Furthermore, the particular features, structures, materials, or characteristics described may be combined in a suitable manner in any one or more embodiments or examples. In addition, as long as without contradiction, various embodiments or examples described in the specification, as well as features of various embodiments or examples, may be jointed and combined by those skilled in the art.

While the embodiments of the present disclosure have been shown and described above, it could be understood that the foregoing embodiments are exemplarily and are not to be construed as limiting the scope of the disclosure. Variations, modifications, substitutions and alterations of the above-described embodiments may be made by those skilled in the art within the scope of the present disclosure.

What is claimed is:

1. A gate driving unit circuit pair, comprising a first gate driving unit circuit and a second gate driving unit circuit, wherein the first gate driving unit circuit and the second gate driving unit circuit are configured to drive a same pixel circuit simultaneously; each of the first gate driving unit circuit and the second gate driving unit circuit comprises an input sub-circuit, a reset sub-circuit, a first output sub-circuit, a second output sub-circuit, a coupling and isolation sub-circuit, an input terminal, a reset terminal, a first preset power supply terminal, a clock signal terminal, a first output terminal, and a second output terminal; the input sub-circuit, the reset sub-circuit, the first output sub-circuit, and the second output sub-circuit are coupled to a pull-up node; the first output terminal is coupled respectively to the second output sub-circuit and the coupling and isolation sub-circuit; the second output terminal is coupled respectively to the first output sub-circuit and the coupling and isolation sub-circuit; and the first output terminal of the first gate driving unit circuit is coupled to the first output terminal of the second gate driving unit circuit, wherein the input sub-circuit is configured to input an input signal provided by the input terminal to the pull-up node;

the first output sub-circuit is configured to output and provide a clock signal provided by the clock signal terminal to the second output terminal, under a control of a voltage of the pull-up node;

the second output sub-circuit is configured to output and provide the clock signal provided by the clock signal terminal to the first output terminal, under the control of the voltage of the pull-up node;

the reset sub-circuit is configured to reset the pull-up node via a voltage provided by the first preset power supply terminal, under a control of a reset signal provided by the reset terminal; and the coupling and isolation sub-circuit is configured to: isolate a signal of the first output terminal from a signal of the second output terminal in response to the first output sub-circuit outputting the clock signal to the second output terminal, and couple the signal of the first output terminal to the second output terminal in response to the first output sub-circuit not outputting the clock signal.

2. The gate driving unit circuit pair of claim 1, wherein the coupling and isolation sub-circuit comprises a first capacitor, wherein a first terminal of the first capacitor is coupled to the second output terminal, and a second terminal of the first capacitor is coupled to the first output terminal.

3. The gate driving unit circuit pair of claim 2, wherein the first output sub-circuit comprises a first transistor, wherein a control terminal of the first transistor is coupled to the pull-up node, a first terminal of the first transistor is coupled to the clock signal terminal, and a second terminal of the first transistor is coupled to the second output terminal.

4. The gate driving unit circuit pair of claim 3, wherein the second output sub-circuit comprises:

a second transistor, wherein a control terminal of the second transistor is coupled to the pull-up node, and a first terminal of the second transistor is coupled to the clock signal terminal; and a second capacitor, wherein a first terminal of the second capacitor is coupled to the pull-up node, and a second terminal of the second capacitor is coupled to a second terminal of the second transistor and the first output terminal.

5. The gate driving unit circuit pair of claim 4, wherein the input sub-circuit comprises a third transistor, wherein a first terminal and a control terminal of the third transistor are coupled to the input terminal respectively, and a second terminal of the third transistor is coupled to the pull-up node;

the reset sub-circuit comprises a fourth transistor, wherein a control terminal of the fourth transistor is coupled to the reset terminal, a first terminal of the fourth transistor is coupled to the pull-up node, and a second terminal of the fourth transistor is coupled to the first preset power supply terminal.

6. The gate driving unit circuit pair of claim 5, wherein a capacitance value of the first capacitor satisfies the following condition:

$$\frac{C_1}{C_1 + C_2} \times \Delta V_G - V_{LVGL} \geq \max(V_{th}(M3), V_{th}(M4))$$

wherein, $C_1$ is the capacitance value of the first capacitor, $C_2$ is a capacitance value of the second capacitor, $\Delta V_G$ is pulse voltage amplitude output by the first gate driving unit circuit and the second gate driving unit circuit in the gate driving unit circuit pair, $V_{LVGL}$ is a voltage provided by the first preset power supply terminal, $V_{th}$(M3) is a turn-on voltage of the third transistor, and $V_{th}$ (M4) is a turn-on voltage of the fourth transistor.

7. The gate driving unit circuit pair of claim 1, wherein each of the first gate driving unit circuit and the second gate driving unit circuit further comprises a noise control sub-circuit, a first de-noising sub-circuit, a first noise reduction control terminal, and a second noise reduction control terminal, wherein the noise control sub-circuit and the first de-noising sub-circuit are respectively coupled to both a first pull-down node and a second pull-down node, and the first pull-down node is different from the second pull-down node;

the noise control sub-circuit is further coupled to the first noise reduction control terminal, the second noise reduction control terminal, and the first preset power supply terminal, respectively, and is configured to pull up a voltage of the first pull-down node based on a first noise reduction signal provided by the first noise reduction control terminal, and to pull up a voltage of the second pull-down node based on a second noise reduction signal provided by the second noise reduction control terminal;

the first de-noising sub-circuit is further coupled to the pull-up node and the first preset power supply terminal respectively, and is configured to de-noise the voltage of the pull-up node via the voltage provided by the first preset power supply terminal, under a control of the voltage of at least one of the first pull-down node and the second pull-down node.

8. The gate driving unit circuit pair of claim 7, wherein each of the first gate driving unit circuit and the second gate driving unit circuit further comprises a second de-noising sub-circuit and a second preset power supply terminal, wherein the second de-noising sub-circuit is coupled to the first output terminal, the first pull-down node, the second pull-down node, and the second preset power supply terminal respectively, and is configured to de-noise an output signal of the first output terminal via a voltage provided by the second preset power supply terminal, under the control of the voltage of at least one of the first pull-down node and the second pull-down node.

9. The gate driving unit circuit pair of claim 8, wherein each of the first gate driving unit circuit and the second gate driving unit circuit further comprises a third de-noising sub-circuit, wherein the third de-noising sub-circuit is coupled to the second output terminal, the first pull-down node, the second pull-down node, and the first preset power supply terminal respectively, and is configured to de-noise an output signal of the second output terminal via the voltage provided by the first preset power supply terminal, under the control of the voltage of at least one of the first pull-down node and the second pull-down node.

10. The gate driving unit circuit pair of claim 7, wherein the noise control sub-circuit comprises a first noise control sub-circuit and a second noise control sub-circuit, wherein the first noise control sub-circuit comprises:

a fifth transistor, wherein a first terminal and a control terminal of the fifth transistor are coupled to the first noise reduction control terminal respectively;

a sixth transistor, wherein a control terminal of the sixth transistor is coupled to a second terminal of the fifth transistor, a first terminal of the sixth transistor is coupled to the first noise reduction control terminal, and a second terminal of the sixth transistor is coupled to the first pull-down node;

a seventh transistor, wherein a first terminal of the seventh transistor is coupled to the second terminal of the fifth transistor, and a second terminal of the seventh transistor is coupled to the first preset power supply terminal;

an eighth transistor, wherein a first terminal of the eighth transistor is coupled to the first pull-down node, a second terminal of the eighth transistor is coupled to the first preset power supply terminal, and a control terminal of the eighth transistor is coupled to a control terminal of the seventh transistor and the pull-up node, the second noise control sub-circuit comprises:

a ninth transistor, wherein a first terminal and a control terminal of the ninth transistor are coupled to the second noise reduction control terminal respectively;

a tenth transistor, wherein a control terminal of the tenth transistor is coupled to a second terminal of the ninth transistor, a first terminal of the tenth transistor is coupled to the second noise reduction control terminal, and a second terminal of the tenth transistor is coupled to the second pull-down node;

an eleventh transistor, wherein a first terminal of the eleventh transistor is coupled to the second terminal of the ninth transistor, and a second terminal of the eleventh transistor is coupled to the first preset power supply terminal;

a twelfth transistor, wherein a first terminal of the twelfth transistor is coupled to the second pull-down node, a second terminal of the twelfth transistor is coupled to the first preset power supply terminal, and a control terminal of the twelfth transistor is coupled to a control terminal of the eleventh transistor and the pull-up node.

11. The gate driving unit circuit pair of claim 7, wherein the first de-noising sub-circuit comprises:

a thirteenth transistor, wherein a control terminal of the thirteenth transistor is coupled to the first pull-down node, a first terminal of the thirteenth transistor is coupled to the pull-up node, and a second terminal of the thirteenth transistor is coupled to the first preset power supply terminal;

a fourteenth transistor, wherein a control terminal of the fourteenth transistor is coupled to the second pull-down node, a first terminal of the fourteenth transistor is coupled to the pull-up node, and a second terminal of the fourteenth transistor is coupled to the first preset power supply terminal.

12. The gate driving unit circuit pair of claim 8, wherein the second de-noising sub-circuit comprises:

a fifteenth transistor, wherein a control terminal of the fifteenth transistor is coupled to the first pull-down node, a first terminal of the fifteenth transistor is coupled to the first output terminal, and a second terminal of the fifteenth transistor is coupled to the second preset power supply terminal;

a sixteenth transistor, wherein a control terminal of the sixteenth transistor is coupled to the second pull-down node, a first terminal of the sixteenth transistor is coupled to the first output terminal, and a second terminal of the sixteenth transistor is coupled to the second preset power supply terminal.

13. The gate driving unit circuit pair of claim 9, wherein the third de-noising sub-circuit comprises:

a seventeenth transistor, wherein a control terminal of the seventeenth transistor is coupled to the first pull-down node, a first terminal of the seventeenth transistor is coupled to the second output terminal, and a second terminal of the seventeenth transistor is coupled to the first preset power supply terminal;

an eighteenth transistor, wherein a control terminal of the eighteenth transistor is coupled to the second pull-down node, a first terminal of the eighteenth transistor is coupled to the second output terminal, and a second terminal of the eighteenth transistor is coupled to the first preset power supply terminal.

14. The gate driving unit circuit pair of claim 1, wherein each of the first gate driving unit circuit and the second gate driving unit circuit further comprises a discharge sub-circuit and a frame start terminal, wherein the discharge sub-circuit is coupled to the frame start terminal, the pull-up node, and the first preset power supply terminal, respectively, and is configured to pulldown the voltage of the pull-up node via the voltage provided by the first preset power supply terminal, under a control of a frame start signal provided by the frame start terminal.

15. The gate driving unit circuit pair of claim 14, wherein the discharge sub-circuit comprises:

a nineteenth transistor, wherein a control terminal of the nineteenth transistor is coupled to the frame start terminal, a first terminal of the nineteenth transistor is coupled to the pull-up node, and a second terminal of the nineteenth transistor is coupled to the first preset power supply terminal.

16. A gate driving circuit, comprising the gate driving unit circuit pair of claim 1, a start signal line, a clock signal line, a first noise reduction control line, a second noise reduction control line, a frame start signal line, a first preset power supply line, and a second preset power supply line, wherein the input terminal of the first gate driving unit circuit in a 1st gate driving unit circuit pair is coupled to the start signal line, the second output terminal of the first gate driving unit circuit in the 1st gate driving unit circuit pair is coupled to the input terminal of the first gate driving unit circuit in a 2nd gate driving unit circuit pair, and the second output terminal of the first gate driving unit circuit in an i-th gate driving unit circuit pair is coupled to the reset terminal of the first gate driving unit circuit in an (i−1)-th gate driving unit circuit pair and the input terminal of the first gate driving unit circuit in an (i+1)-th gate driving unit circuit pair respectively, wherein i is a positive integer greater than 1;

the input terminal of the second gate driving unit circuit in the 1st gate driving unit circuit pair is coupled to the start signal line, the second output terminal of the second driving unit circuit in the 1st gate driving unit circuit pair is coupled to the input terminal of the second gate driving unit circuit in the 2nd gate driving unit circuit pair, and the second output terminal of the second gate driving unit circuit in the i-th gate driving unit circuit pair is coupled to the reset terminal of the second gate driving unit circuit in the (i−1)-th gate driving unit circuit pair and the input terminal of the second gate driving unit circuit in the (i+1)-th gate driving unit circuit pair;

the first output terminals of the first gate driving unit circuit and the second gate driving unit circuit in each of the gate driving unit circuit pairs are coupled to a gate line of a same pixel circuit; the clock signal terminal, a first noise reduction control terminal, a second noise reduction control terminal, a frame start terminal, the first preset power supply terminal, and a second preset power supply terminal of the first gate driving unit circuit in each of the gate driving unit circuit pairs are coupled to the clock signal line, the first noise reduction control line, the second noise reduction control line, the frame start signal line, the first preset power supply line, and the second preset power supply line respectively; and the clock signal terminal, a first noise reduction control terminal, a second noise reduction control terminal, a frame start terminal, the first preset power supply terminal, and a second preset power supply terminal of the second gate driving unit circuit in each of the gate driving unit circuit pairs are coupled to the clock signal line, the first noise reduction control line, the second noise reduction control line, the frame start signal line, the first preset power supply line, and the second preset power supply line respectively.

17. A display device, comprising the gate driving circuit of claim 16.

18. A driving method for a gate driving unit circuit pair, the gate driving unit circuit pair comprising a first gate driving unit circuit and a second gate driving unit circuit, wherein the first gate driving unit circuit and the second gate driving unit circuit are configured to drive a same pixel circuit simultaneously; each of the first gate driving unit circuit and the second gate driving unit circuit comprises an input sub-circuit, a reset sub-circuit, a first output sub-circuit, a second output sub-circuit, a coupling and isolation sub-circuit, an input terminal, a reset terminal, a first preset power supply terminal, a clock signal terminal, a first output terminal, and a second output terminal; the input sub-circuit, the reset sub-circuit, the first output sub-circuit, and the second output sub-circuit are coupled to a pull-up node; the first output terminal is coupled respectively to the second output sub-circuit and the coupling and isolation sub-circuit; the second output terminal is coupled respectively to the first output sub-circuit and the coupling and isolation sub-circuit; and the first output terminal of the first gate driving unit circuit is coupled to the first output terminal of the second gate driving unit circuit, wherein for each of the first gate driving unit circuit and the second gate driving unit circuit, the driving method comprises:

inputting an input signal provided by the input terminal, via the input sub-circuit, to the pull-up node;

outputting and providing a clock signal provided by the clock signal terminal, via the first output sub-circuit, to the second output terminal, under a control of a voltage of the pull-up node;

outputting and providing the clock signal provided by the clock signal terminal, via the second output sub-circuit, to the first output terminal, under the control of the voltage of the pull-up node;

resetting the pull-up node, via the reset sub-circuit, by a voltage provided by the first preset power supply terminal, under a control of a reset signal provided by the reset terminal;

isolating a signal of the first output terminal from a signal of the second output terminal via the coupling and isolation sub-circuit in response to the first output sub-circuit outputting the clock signal to the second output terminal; and coupling the signal of the first output terminal to the second output terminal via the coupling and isolation sub-circuit in response to the first output sub-circuit not outputting the clock signal.

19. The driving method of claim 18, wherein when the first output sub-circuit of the first gate driving unit circuit does not output the clock signal, the signal of the first output terminal of the first gate driving unit circuit is a clock signal output by one of the second output sub-circuit of the first gate driving unit circuit and the second output sub-circuit of the second gate driving unit circuit.

20. A gate driving unit circuit pair, comprising a first gate driving unit circuit and a second gate driving unit circuit, wherein the first gate driving unit circuit and the second gate driving unit circuit are configured to drive a same pixel circuit simultaneously, and each of the first gate driving unit circuit and the second gate driving unit circuit comprises: a first transistor, a second transistor, a third transistor, a fourth transistor, a fifth transistor, a sixth transistors, a seventh transistor, an eighth transistor, a ninth transistor, a tenth transistor, an eleventh transistor, a twelfth transistor, a thirteenth transistor, a fourteenth transistor, a fifteenth transistor, a sixteenth transistor, a seventeenth transistor, an eighteenth transistor, a nineteenth transistor, a first capacitor, a second capacitor, an input terminal, a reset terminal, a first output terminal, a second output terminal, a first noise reduction control terminal, a second noise reduction control terminal, a first preset power supply terminal, a second preset power supply terminal, a frame start terminal, and a clock signal terminal, wherein a control terminal of the first transistor is respectively coupled to a control terminal of the second transistor, a second terminal of the third transistor, a first terminal of the fourth transistor, a control terminal of the seventh transistor, a control terminal of the eighth transistor, a control terminal of the eleventh transistor, a control terminal of the twelfth transistor, a first terminal of the thirteenth transistor, a first terminal of the fourteenth transistor, a first terminal of the nineteenth transistor and a first terminal of the second capacitor; a first terminal of the first transistor is coupled to the clock signal terminal; and a second terminal of the first transistor is respectively coupled to the second output terminal, a first terminal of the first capacitor, a first terminal of the seventeenth transistor and a first terminal of the eighteenth transistor;

a first terminal of the second transistor is coupled to the clock signal terminal; a second terminal of the second transistor is respectively coupled to the first output terminal, a second terminal of the second capacitor, a second terminal of the first capacitor, a first terminal of the fifteenth transistor, and a first terminal of the sixteenth transistor;

a first terminal and a control terminal of the third transistor are respectively coupled to the input terminal;

a control terminal of the fourth transistor is coupled to the reset terminal, and a second terminal of the fourth transistor is coupled to the first preset power supply terminal;

a first terminal and a control terminal of the fifth transistor are respectively coupled to the first noise reduction control terminal, and a second terminal of the fifth transistor is respectively coupled to a control terminal of the sixth transistor and a first terminal of the seventh transistor;

a first terminal of the sixth transistor is coupled to the first noise reduction control terminal, and a second terminal of the sixth transistor is respectively coupled to a first terminal of the eighth transistor, a control terminal of the thirteenth transistor, a control terminal of the fifteenth transistor and a control terminal of the seventeenth transistor;

a second terminal of the seventh transistor is coupled to the first preset power supply terminal;

a second terminal of the eighth transistor is coupled to the first preset power supply terminal;

a first terminal and a control terminal of the ninth transistor are respectively coupled to the second noise reduction control terminal, and a second terminal of the ninth transistor is respectively coupled to a control terminal of the tenth transistor and a first terminal of the eleventh transistor;

a first terminal of the tenth transistor is coupled to the second noise reduction control terminal, and the second terminal of the tenth transistor is respectively coupled to a first terminal of the twelfth transistor, a control terminal of the fourteenth transistor, a control terminal of the sixteenth transistor, and a control terminal of the eighteenth transistor;

a second terminal of the eleventh transistor is coupled to the first preset power supply terminal;

a second terminal of the twelfth transistor is coupled to the first preset power supply terminal;

a second terminal of the thirteenth transistor is coupled to the first preset power supply terminal;

a second terminal of the fourteenth transistor is coupled to the first preset power supply terminal;

a second terminal of the fifteenth transistor is coupled to the second preset power supply terminal;

a second terminal of the sixteenth transistor is coupled to the second preset power supply terminal;

a second terminal of the seventeenth transistor is coupled to the first preset power supply terminal;

a second terminal of the eighteenth transistor is coupled to the first preset power supply terminal;

a control terminal of the nineteenth transistor is coupled to the frame start terminal, and a second terminal of the nineteenth transistor is coupled to the first preset power supply terminal; wherein the first output terminal of the first gate driving unit circuit is coupled to the first output terminal of the second gate driving unit circuit to drive the same pixel circuit simultaneously.

* * * * *